US008485700B2

(12) United States Patent
Ngai

(10) Patent No.: US 8,485,700 B2
(45) Date of Patent: Jul. 16, 2013

(54) LOW PROFILE OLED LUMINAIRE FOR GRID CEILINGS

(75) Inventor: Peter Y. Y. Ngai, Alamo, CA (US)

(73) Assignee: ABL IP Holding, LLC, Conyers, GA (US)

( * ) Notice: Subject to any disclaimer, the term of this patent is extended or adjusted under 35 U.S.C. 154(b) by 400 days.

(21) Appl. No.: 12/774,660

(22) Filed: May 5, 2010

(65) Prior Publication Data

US 2010/0284185 A1 Nov. 11, 2010

Related U.S. Application Data

(60) Provisional application No. 61/175,767, filed on May 5, 2009.

(51) Int. Cl.
*F21V 33/00* (2006.01)

(52) U.S. Cl.
USPC ..... 362/404; 362/148; 362/150

(58) Field of Classification Search
USPC ..... 362/148, 150, 404, 364, 365, 368
See application file for complete search history.

(56) References Cited

U.S. PATENT DOCUMENTS

| | | | | |
|---|---|---|---|---|
| 4,768,140 | A | 8/1988 | Szpur | |
| 5,803,585 | A | 9/1998 | Littman et al. | |
| 6,402,349 | B1 | 6/2002 | Miller et al. | |
| 6,851,211 | B2 | 2/2005 | Sender | |
| 7,175,296 | B2 * | 2/2007 | Cok | 362/147 |
| 7,547,112 | B2 * | 6/2009 | Kim | 362/148 |
| 7,645,052 | B2 | 1/2010 | Villard | |
| 7,658,046 | B2 * | 2/2010 | Lynch et al. | 52/506.07 |
| 2002/0136001 | A1 | 9/2002 | Lefkovitz et al. | |
| 2002/0141181 | A1 * | 10/2002 | Bailey | 362/150 |
| 2004/0252488 | A1 | 12/2004 | Thurk | |
| 2005/0141216 | A1 | 6/2005 | McCarthy | |
| 2006/0285361 | A1 * | 12/2006 | Cok | 362/633 |
| 2007/0001927 | A1 | 1/2007 | Ricks et al. | |
| 2010/0108998 | A1 | 5/2010 | Verjans et al. | |
| 2010/0182797 | A1 | 7/2010 | Wells | |

FOREIGN PATENT DOCUMENTS

WO W02010129717 11/2010

* cited by examiner

*Primary Examiner* — Laura Tso
(74) *Attorney, Agent, or Firm* — Donald L. Beeson; Beeson Skinner Beverly, LLP

(57) ABSTRACT

A low-profile luminaire has a planar light source comprised of one or more planar organic light emitting diodes (OLEDs). The OLED light source is supported by a low-profile OLED support structure that lies in a plane. The support structure has a maximum height (H) of about two inches and preferably a height of about one inch or less. It also has perimeter dimensions that allow the luminaire to fit within and to be supported by the T-bar grid of a grid ceiling system. Electrical components for driving and controlling the OLED light source can be provided within the support structure or externally of this structure.

33 Claims, 17 Drawing Sheets

LOW PROFILE OLED LUMINAIRE FOR GRID CEILINGS

CROSS-REFERENCE TO RELATED APPLICATIONS

This application claims the benefit of U.S. provisional patent application No. 61/175,767, filed May 5, 2009, which is incorporated herein by reference.

BACKGROUND OF THE INVENTION

The present invention generally relates to luminaires, and more particularly to luminaires used with grid ceiling systems.

Grid ceiling systems are commonly used in commercial buildings, schools, and other interior structures. Such ceiling systems are created by suspending a T-bar grid from the building's structural ceiling and filling the T-bar grid with ceiling tiles. The T-bar grid is made up of interconnected T-bars that form grid openings for the ceiling tiles, which, when dropped into the grid openings, are supported on the T-bars' bottom horizontal T-walls. The most common dimensions for the grid openings are the two foot by two foot and four foot by four foot for supporting similarly sized ceiling tiles, however, other grid opening dimensions are possible for accommodating different ceiling tile sizes, for example five foot by five foot tiles. Ceiling tiles used in grid ceilings are typically acoustic tiles for enhancing the acoustical environment of the interior space below the grid ceiling.

Customarily, luminaires are provided in the grid ceiling system for general illumination. Luminaires adapted for this use are called troffers, and are typically fluorescent luminaires having fluorescent light sources, however, other light sources, such as incandescent and HID lamps are sometimes used. Troffers are sized in correspondence with the grid openings of the T-bar grid and are mounted in selected grid openings instead of a ceiling tile. (The number and distribution of the troffers on the grid ceiling depend on the type of troffer used and the general lighting requirements of the space.) Parabolic troffers and lens troffers are currently the most common luminaires designed for T-bar grid mounting; however, other types of troffers are commercially available, for example, troffers with a secondary perforated reflector under the lamps.

The physical dimensions of the lamps, lamp sockets, and optical components used in conventional troffers require that the troffer have a minimum height. While the height of commercially available troffers varies, most have a height of at least three inches. Thinner troffers have been designed for T-5 fluorescent lamps, which have a relatively small diameter (⅝ inches), but the component dimensions of such troffers would still impose a lower limit on the height on the troffer. Generally, troffer heights less than about 1½ inch would be difficult to achieve.

The height of a troffer can have important implications in the shipment, installation, use, and ultimately the disposal of the troffers. For example, the height of the troffer determines its volume and the greater the volume the greater space and packaging material that will be needed to ship the troffers. The presence of the troffers in the grid ceiling must also be taken into account when determining the space required between the grid ceiling system and the building's overhead structural ceiling. The space between the top of the troffers and the structural ceiling has to be adequate to accommodate HVAC and fire alarm systems, sprinkler piping, and other utilities in the building. Use of conventional troffers, which have a depth that causes the troffers to protrude significantly above the grid ceiling, adds to this space requirement. This added space requirement can be meaningful in terms of building construction costs. For example, a reduction of three inches in the requirement for the space above the grid ceiling will translate to three inches less in the requirement for the separation between the building's structural floors and structural ceilings. This can, in turn, result in less material required to construct the building due to a reduction in overall building height. Or it can possibly allow for an additional floor being added to a high rise building. For example, a three inch saving in the space above the grid ceiling will allow a floor to be added to a 40-story high rise building normally having a structural floor to structural floor dimension of 10 feet.

SUMMARY OF INVENTION

The present invention provides a very low profile luminaire adapted for use in grid ceiling systems, which preferably has a luminaire height of no greater than approximately two inches and which can be provided in heights of one inch or less. The very low profile of the luminaire of the invention reduces the space above a grid ceiling system occupied by the luminaire, or eliminates it altogether by allowing luminaires to be created for grid ceilings having a bottom to top height (thickness) no greater than the height of the grid ceiling T-bars. The luminaire's low profile results in a reduction in material required for the luminaire structure and packaging, and in a reduction in the weight of the luminaire. The low profile will also increase the number of luminaires that can be transported in a shipping container. These advantages will in turn reduce fuel consumption for transporting the luminaires on a per luminaire basis, and volume of disposal material at the luminaires' end of life.

It is contemplated that the reduction in the weight of the luminaire will also reduce installation costs. For safety reasons, building codes normally require the use of overhead "tie wires" for the installation of conventional troffers. The tie wires are intended to support the weight of the troffers. However, under most code provisions, tie wires would not be required if the fixture is less than a certain weight. The low profile luminaire of the invention can be made light enough to allow installation using only "clips" to hold the fixture onto the T-bars of the grid ceiling, thus eliminating the need for tie wires.

The present invention provides a low profile luminaire having a planar light source comprised of one or more planar organic light emitting diodes (OLEDs), which are flat light sources that can be very thin (in the range of 1 mm or less). The OLED light source is supported by a low profile OLED support structure that lies in a plane. The support structure, which supports the planar OLED light source substantially in the plane of the support structure, preferably has a maximum height of about two inches and preferably a height of about one inch or less. It also has perimeter dimensions that allow the luminaire to fit within and to be supported by the T-bar grid openings of a grid ceiling system. Electrical components for driving and controlling the OLED light source can be provided within the support structure or externally of this structure.

DESCRIPTION OF THE DRAWINGS

FIGS. 36-41 are graphical depictions of examples of configurations for the planar OLED light source of the invention created using multiple OLED panels.

DESCRIPTION OF THE ILLUSTRATED EMBODIMENTS

It is first noted that the luminaires depicted in the accompanying drawings are not necessarily to scale and appear as having a height (denoted by the letter "H") relative to their perimeter dimensions that are larger than would be the case in the physical implementation of the luminaire.

Figure 1:
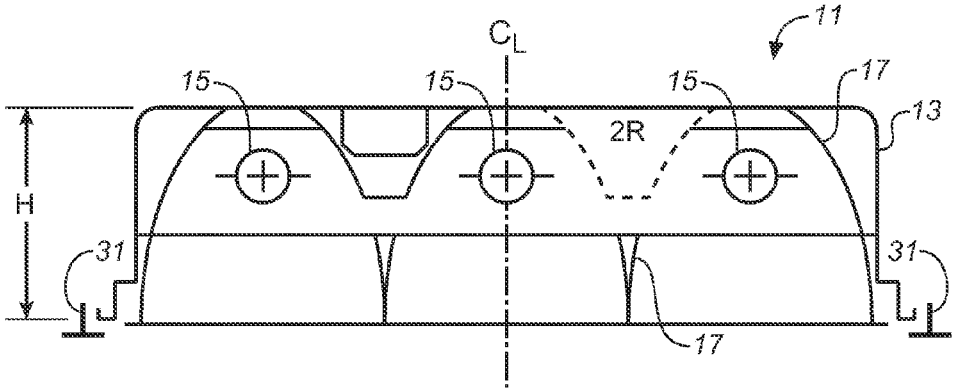
FIG. 1 (PRIOR ART)
FIG. 1 is a graphical illustration of a conventional recessed parabolic troffer used for grid ceiling systems.
Figure 2:
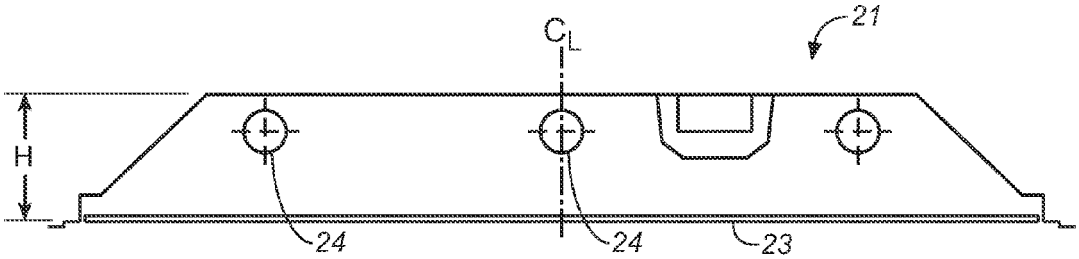
FIG. 2 (PRIOR ART)
FIG. 2 is a graphical illustration of a conventional recessed lensed troffer used for grid ceiling systems.
Figure 3:
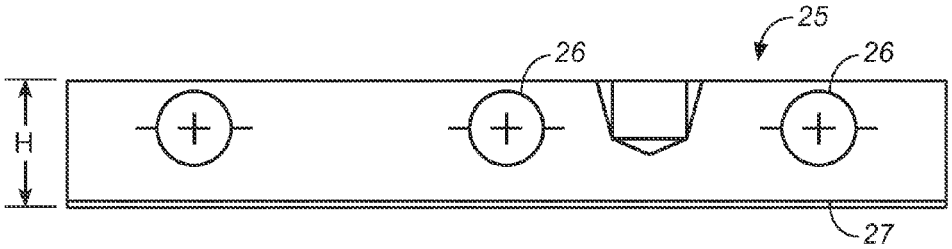
FIG. 3 (PRIOR ART)
FIG. 3 is a graphical illustration of a conventional surface mount lens troffer used for grid ceiling systems.
Figure 4:
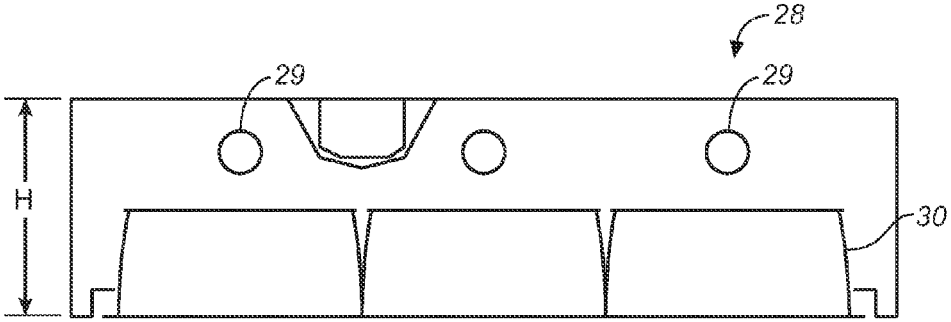
FIG. 4 (PRIOR ART)
FIG. 4 is a graphical illustration of a conventional surface mount parabolic troffer used for grid ceiling systems.

Referring to the drawings, FIGS. 1-4 graphically illustrate different types of conventional luminaires used with grid ceiling systems. FIG. 1 shows a luminaire in the form of a conventional recessed, parabolic troffer 11, which includes a housing 13 having sufficient height H to accommodate the troffer's fluorescent lamps 15 and surrounding parabolic reflectors 17. FIG. 2 shows another conventional recessed troffer used for grid ceiling systems. In this case, the recessed troffer is a lensed troffer 21, having a lens cover 23 which covers the troffer's fluorescent lamps 24. FIGS. 3 and 4 graphically illustrate surface-mounted troffers. FIG. 3 shows a surface-mounted lensed troffer 25 having fluorescent lamps 26 and lens cover 27, and FIG. 4 shows a parabolic troffer 28 with fluorescent lamps 29 positioned over parabolic reflectors 30.

Due to the physical dimensions of the fluorescent lamps, lamp sockets, and optical components used in the illustrated conventional troffers, the height of the troffers normally exceed three inches. For example, an exemplary height for the recessed parabolic troffer shown in FIG. 1 is 4½ inches, resulting in a troffer that extends 4.5 inches above the plane of the grid ceiling, represented by T-bars 31. A two foot wide lensed troffer as shown in FIG. 2 would typically have a height H in the range of 3 3/16 inches, which is somewhat less than the height of the parabolic troffer, due to the elimination of the troffer's parabolic reflectors. A typical height H for the surface-mounted lensed troffer such as shown in FIG. 3 is in the range of 3¾ inches. For surface mounted troffers such as shown in FIG. 4, the height is much larger, typically about 6 11/16 inches.

As above mentioned, specially designed troffers for T-5 fluorescent lamps can be made to be thinner than the illustrated troffers, but potential height reduction is still limited by the component dimensions.

The present invention provides a luminaire having a height or profile which can be substantially less than conventional troffers, and which are uniquely adapted for use with grid ceiling systems employing a T-bar grid for supporting ceiling tiles, most commonly in 2'×2' or 4'×4' configurations. It is contemplated that a low profile luminaire in accordance with the invention will have a height less than or comparable to the height of commonly used T-bars in such grid ceiling systems, and, in particular, a height that is no greater than approximately two inches. Such a low profile luminaire can sit within the T-bar grill of a grid ceiling system without occupying any appreciable portion of the space between the T-bar grid and the overhead structural ceiling.

Figure 5:
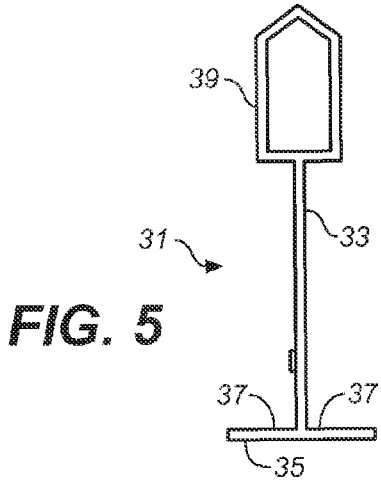
FIG. 5 is a sectional view of a common type of T-bar used for the T-bar grids of a grid ceiling system.

FIG. 5 shows, for illustrative purposes, the cross-sectional profile of a commonly used T-bar for a grid ceiling. The T-bar, denoted by the numeral 31, is seen to have a vertical wall 33 terminated at its bottom end by a horizontal T-wall 35, extending to either side of the vertical wall. A horizontal T-wall provides horizontal top support surfaces 37 for supporting ceiling tiles within the T-bar grid. As hereinafter described, the horizontal T-walls of the T-bars will also support the low profile luminaires in accordance with the invention at selected locations within the T-bar grid. The top end of the vertical wall 33 is terminated by a channel rail 39, to which tie wires can be secured for hanging the T-bar grid. A typical overall height for the T-bar style shown in FIG. 5 is typically 1 11/16 inches, with the height of the vertical wall 33 being in the range of 1⅛ inches. Thus, a low profile luminaire in accordance with the invention having a height of 1⅛ inches or less can be supported by the T-bar with the luminaire extending no higher than the vertical wall section 33 of the T-bar. A typical overall length of the horizontal T-wall 35 would be 9/16 inches. Other commercially available T-bars have somewhat different dimensions than the exemplary T-bar illustrated in the drawings; however, the overall heights of the T-bars are typically less than two inches, with yet shorter vertical walls. Also, in some common T-bars the length of the horizontal T-walls is close to one inch.

Figure 6:
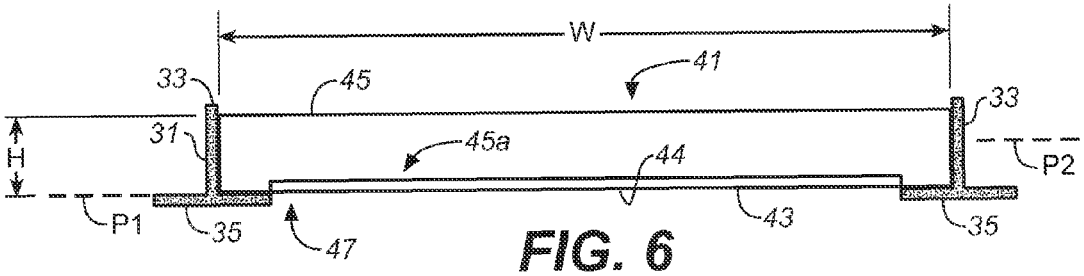
FIG. 6 is a graphical illustration of a T-bar mounted low profile OLED luminaire in accordance with the invention configured as a recessed luminaire.
Figure 7:
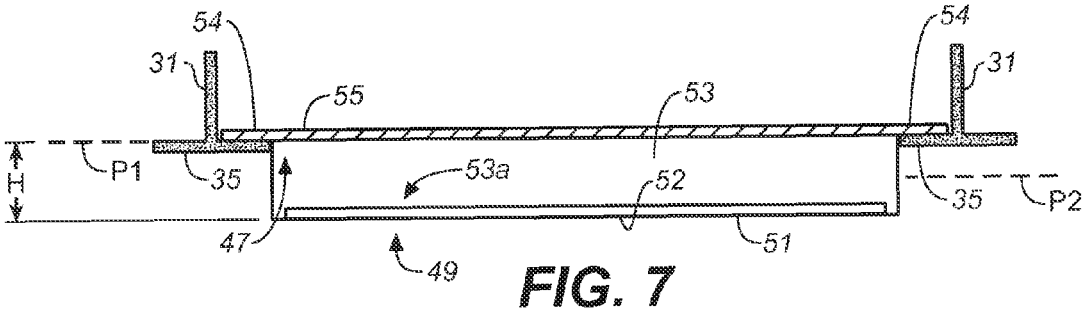
FIG. 7 is a graphical illustration of a T-bar mounted low profile OLED luminaire in accordance with the invention configured to replicate a surface mounted luminaire.
Figure 8:
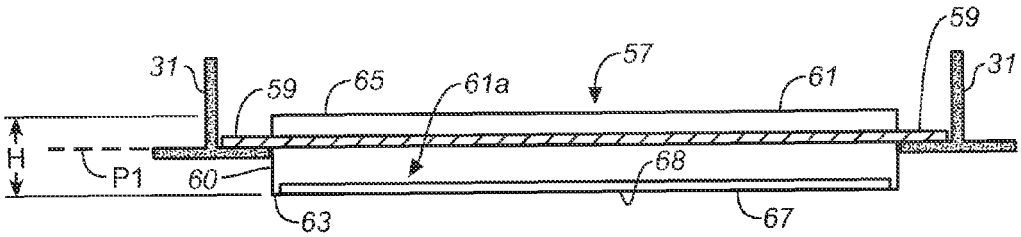
FIG. 8 is a graphical illustration of a T-bar mounted low profile OLED luminaire in accordance with the invention configured as a partially recessed and partially surface mounted luminaire.

A low profile luminaire having a height of less than approximately two inches, and having an optimal height of one inch or less, is uniquely achieved in the present invention by using a planar OLED light source supported in a low profile planar OLED support structure having a perimeter that conforms to the grid openings of the T-bar frame of a grid ceiling system. FIGS. 6-8 conceptually illustrate three configurations for the low profile luminaire of the invention for supporting the luminaire at different height-adjusted positions within a T-bar frame represented by graphically illustrated T-bars 31. In FIG. 6, the graphically represented low profile luminaire 41 is comprised of a planar OLED light source 43 (sometimes referred to herein as an "OLED panel") provided in the bottom 45*a* of the low profile OLED support structure, which is in the form of a low profile planar housing 45. Low profile housing 45 in this embodiment is seen to have a substantially uniform height H and perimeter dimensions, defined by the width W of each side of the housing, corresponding to the spacing between the vertical T-bar walls 33. In a conventional 2'×2' T-bar grid configuration, the width W of each side of the luminaire housing would nominally be approximately two feet. In this embodiment, the OLED panel 43 at the bottom of the low profile housing is sized in correspondence with the T-bar grid opening 47 formed between the horizontal T-walls 35 of T-bars 31. Thus, the OLED panel 43 will extend across substantially the entire opening of the T-bar grid substantially in line with the plane of the grid ceiling, represented by dashed line P1.

It is contemplated that a light output of approximately 1000 lumens to 6000 lumens can be produced from such an OLED panel, such as illustrated in FIG. 6, and from the OLED panels shown in the embodiments of the invention hereinafter described.

The embodiment shown in FIG. 6 represents a T-bar mounted recessed low profile luminaire in accordance with the invention. In FIG. 7, a low profile luminaire in accordance with the invention is provided that replicates a surface-mounted luminaire. In FIG. 7, the luminaire 49, which has a planar OLED light source 51 held at the 53*a* bottom portion of a low profile planar housing 53 having a height H, is supported between T-bars 31 by a laterally extending T-bar engagement structure 54 at or near the top of the housing. This T-bar engagement structure defines the perimeter dimensions of the support structure and can suitably be provided by a rear mounting plate 55 secured to on the top of the low profile housing, which is extends beyond the perimeter of the housing. In this embodiment, the perimeter dimensions of the low profile housing 53 of the luminaire are chosen to allow the housing to fit through the bottom opening 47 of the T-bar grid, so that the OLED light source provided at the bottom 53*a* of the housing drops below the plane of the T-bar grid, and hence the plane of the grid ceiling system.

FIG. 8 graphically illustrates a further mounting scheme for the low profile luminaire of the invention, which is partially recessed, and which partially extends below the grid ceiling. Here, the low profile luminaire 57 is provided with a laterally extending T-bar engagement structure in the form of a flange structure 59 that extends laterally from the perimeter 60 of the luminaire's low profile planar housing 61 between the bottom 63 and top 65 of the housing. This intermediately positioned flange causes the planar OLED light source 67 at the planar bottom 61*a* of the luminaire housing to drop below the grid ceiling to a lesser degree, while the rear of the low profile luminaire housing is recessed somewhat above the grid ceiling.

In each of the embodiments shown in FIGS. 6-8, it is seen that the luminaire's low profile OLED support structure lies in a plane P2 that is parallel to the plane P1 of the grid ceiling. It is also seen that the OLED panel is held by the support structure such that the OLED's bottom light emitting surface (denoted by the numerals 44, 52, 68 in FIGS. 6-8) is oriented in a plane closely parallel to the plane of the support structure. This will be true of the embodiments hereinafter described. This construction provides for luminaires having very low profiles (less than one inch in height), which can be set into a T-bar grid of a grid ceiling.

Figure 9A:
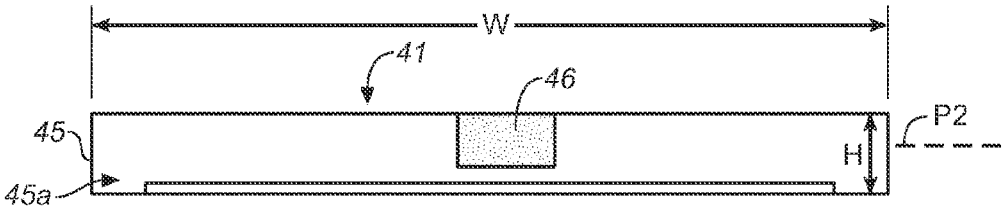
FIG. 9A is a graphical illustration of a low profile OLED luminaire in accordance with the invention showing a low profile OLED support structure and the inclusion of an electrical driver and control unit in the support structure.
Figure 9B:
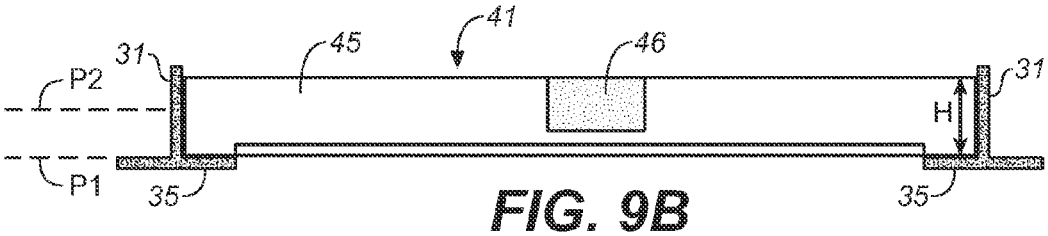
FIG. 9B is a graphical illustration of the OLED luminaire shown in FIG. 9A wherein the luminaire is recess-mounted to the T-bars of a T-bar grid of a grid ceiling system.

An electrical driver and control circuitry is necessary to provide appropriate electrical power and control to the OLED panels illustrated in FIGS. 6-8. FIGS. 9A and 9B graphically illustrate a possible placement for an electrical driver and control unit in the low profile luminaire configuration shown in FIG. 6. In these figures, an electrical driver and control unit 46 contained within the low profile OLED support housing 45 at the center of the housing. The central location of the electrical driver and control unit contained within the housing is for illustrative purposes only. The electrical driver and control unit could be located elsewhere within the housing.

Figure 10A:
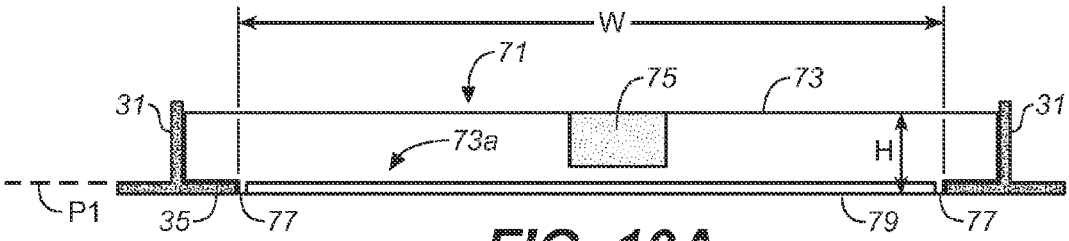
FIG. 10A is a graphical illustration of an alternative embodiment of the OLED luminaire shown in FIGS. 9A and 9B configured to achieve flush mounting with the bottom of the T-bars of the grid ceiling system.

FIG. 10A shows yet another variation of a low profile luminaire in accordance with the invention. Here, the luminaire 71 has a low profile OLED support structure in the form of a low profile housing 73 containing electrical driver and control unit 75. As in the embodiment shown in FIG. 6, the OLED support housing shown in FIG. 10A is dimensioned such that it can be placed directly upon and be supported by the horizontal T-walls 35 of the ceiling grid T-bars 31. However, in this embodiment, the bottom 73*a* of the generally planar OLED housing is provided with a downward projecting portion 77, having a perimeter dimension W that substantially matches the T-bar grid opening formed by horizontal T-walls 35. The OLED panel 79 is mounted within this downward projecting portion such that the OLED panel is flush with the bottom of the T-bar walls 35.

Figure 10B:
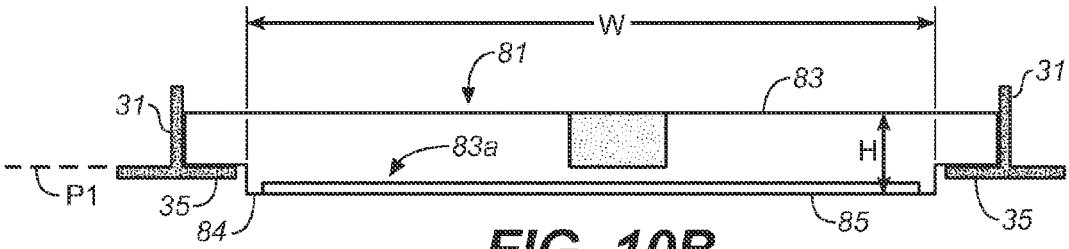
FIG. 10B is a graphical illustration of another embodiment of the T-bar mounted recessed OLED luminaire shown in FIG. 10A.

FIG. 10B shows a variation of the low profile luminaire shown in FIG. 10A. In FIG. 10B, the bottom 83*a* of the low profile OLED support housing 83 of the low profile luminaire 81 has a downward projecting portion 84 for holding the OLED panel 85, which has a perimeter dimension W that is smaller than the grid opening. Also, in this embodiment, the OLED holding downward projecting portion has a greater extension than the downward projection portion shown in the embodiment of FIG. 10A, such that the planar OLED light source is positioned below the horizontal T-walls 35 of T-bars 31.

Figure 11:
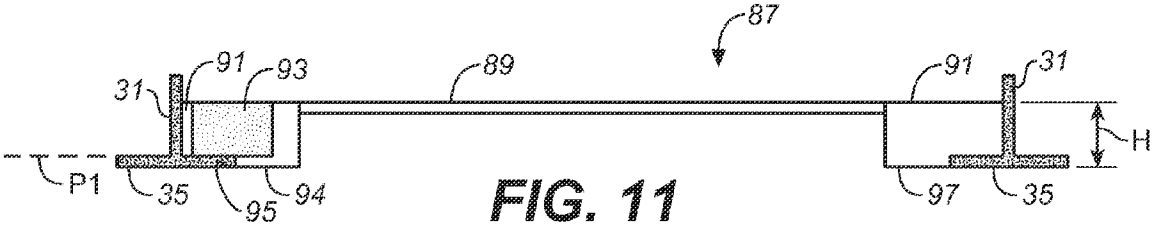
FIG. 11 is a graphical illustration of another embodiment of an OLED luminaire according to the invention, showing another version of the low profile OLED support structure, and the inclusion of an electrical driver and control unit therein.

The low profile OLED support housing for each of the above-described embodiments of the invention has a flat box-shape resembling a square or rectangular panel that spans the entire width of the low profile luminaire. FIG. 11 illustrates an example of a low profile luminaire in accordance with the invention having an alternative support structure configuration that does not span the grid opening. In FIG. 11, the luminaire 87 has a planar OLED light source 89 that is instead supported by a perimeter support structure in the form of a perimeter housing frame 91 for supporting the OLED panel around at least a portion and suitably the entirety of its perimeter. In this embodiment, the electrical driver and control unit 93 for the OLED light source is provided within one edge portion 94 of the perimeter housing frame. The perimeter housing frame, which would have a square or rectangular ring configuration in plan view, has an overall outer dimension that allows the frame to extend over and be supported by the horizontal T-walls 35 of the T-bars 31. The perimeter housing frame suitably has a notch 95 around its bottom outer corner for accommodating the horizontal T-walls. The provision of this notch will allow the bottommost horizontal wall 97 of the perimeter frame to be in line or flush with the bottom of the horizontal T-bar walls so as to provide a finished look to the interface between the luminaire and the T-bar grid.

It is noted that the embodiment of the luminaire showing in FIG. 11 and other embodiments described herein do not have a uniform height across the luminaire. However, the luminaire fits within a low profile envelope, the height of which is defined by the maximum height of the low profile perimeter support structure. Thus, the overall low profile of the luminaire is maintained over the entire luminaire.

Figure 12:
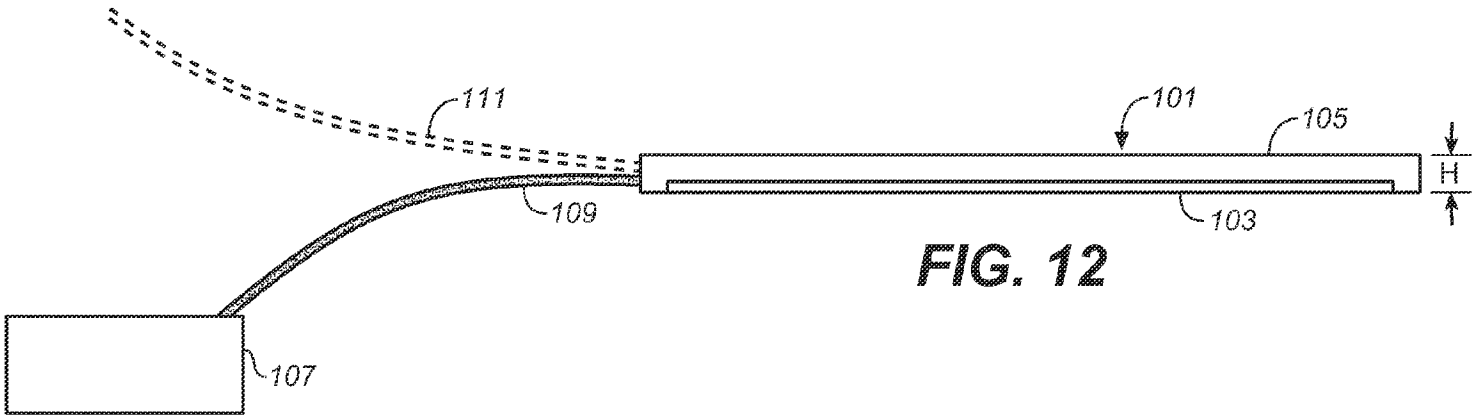
FIG. 12 is a graphical illustration of a further embodiment of the low profile OLED luminaire in accordance with the invention wherein the OLED electrical driver and control is provided remotely of the luminaire.

FIG. 12 shows an embodiment of the low profile luminaire in accordance with the invention, wherein the electrical power supply and controls for the OLED light source are provided remotely from the luminaire. In FIG. 12, the low profile luminaire 101, having planar OLED light source 103 mounted to the bottom of low profile OLED support housing 105, is connected to an external (remote) electrical power supply and controls, represented by block 107, through suitable electrical wiring 109. Alternatively, the low profile luminaire 101 could be wired into a low voltage power bus above the grid ceiling supplied by the building, as graphically represented by the dashed electrical lead lines 111. By removing the electrical driver and controls from the OLED support housing, the luminaire can be made with an extremely thin profile, comparable to the thickness of a ceiling tile. It is understood that any of the embodiments of the invention disclosed in the foregoing figures as having an electrical driver and control unit for the OLED light source contained within the housing could be adapted to the version of the low profile luminaire of the invention where the OLED light source is driven and controlled remotely, as above described.

Figure 13:
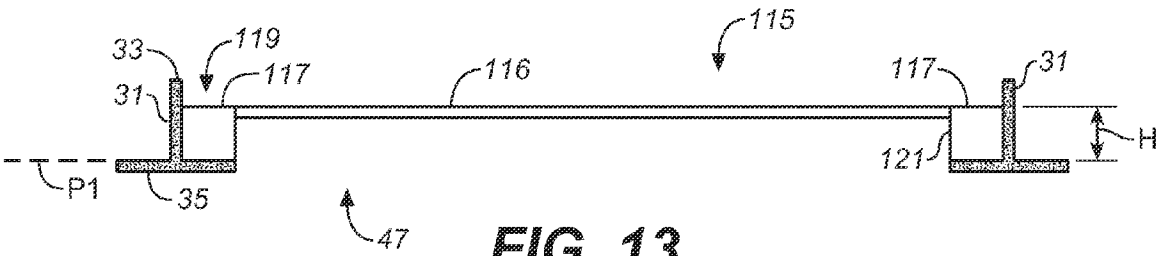
FIG. 13 is a graphical illustration of still another embodiment of a low profile OLED luminaire in accordance with the invention wherein the OLED support structure fits entirely within the T-bars of the T-bar grid.

FIG. 13 illustrates a low profile luminaire in accordance with the invention which is powered and controlled remotely, and in which the luminaire, denoted by the numeral 115, consists almost entirely of the luminaire's planar OLED light source. In FIG. 13, OLED panel 116, which spans the T-bar grid opening 47 formed by T-bars 31, is supported by an OLED support structure in the form of very small profile perimeter support structure in the form of perimeter support frame 117. This perimeter support frame is seen to have a very small cross-sectional shape and dimension that allows the perimeter frame to fit entirely within the L-shaped channel 119 formed by the T-bar's vertical and horizontal T-walls 33, 35. For most T-bars, this would require a perimeter support frame having a width of less than about one-half inch. In this variation of the invention, the OLED support housing 117 essentially disappears in the grid ceiling system, such that the only portion of the support frame seen from below the plane of the ceiling (represented by the dashed line P1) is the perimeter frame's short, interior vertical wall 121.

Figure 14A:
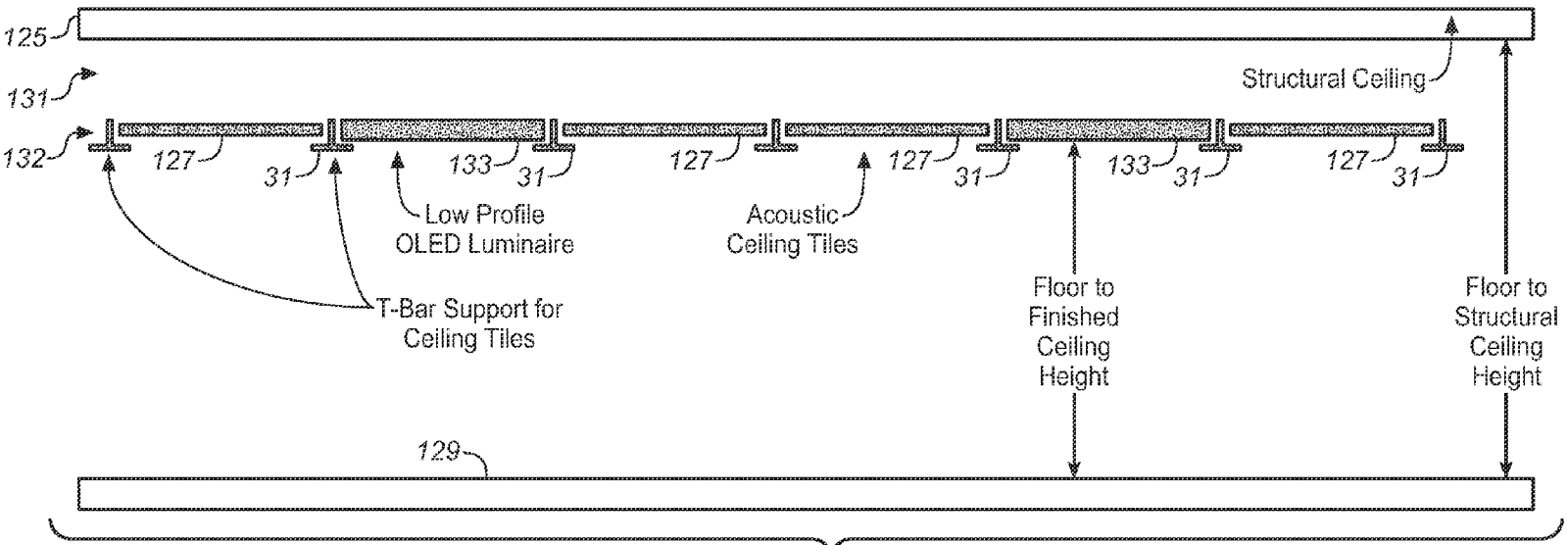
FIG. 14A is a graphical illustration of a grid ceiling system with T-bar mounted recessed low profile OLED luminaires in accordance with the invention interspersed between the tiles of the ceiling system.
Figure 14B:
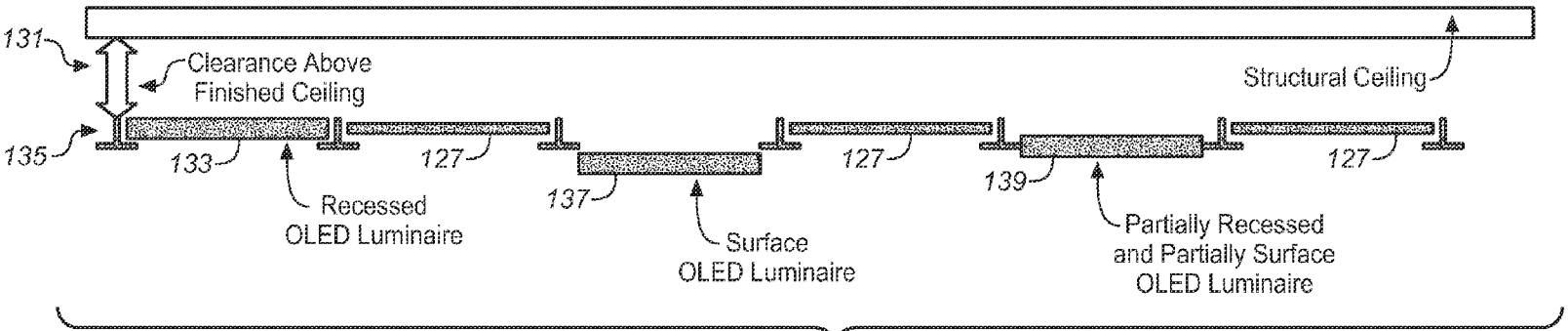
FIG. 14B is a graphical illustration of a grid ceiling system with T-bar mounted low profile OLED luminaires interspersed between the tiles of the ceiling system in different mounting configurations.

FIGS. 14A and 14B illustrate how a low profile OLED luminaire in accordance with the invention can be integrated into a T-bar grid of a grid ceiling system suspended below a structural ceiling to provide a finished ceiling above floor 129. In FIG. 14A, the grid ceiling system 132, which includes T-bars 31, is suspended below structural ceiling 125, conventionally by tie-wires (not shown) attached at one end to the top of the T-bars and at the other to anchors in the super-adjacent ceiling structure. Acoustic ceiling tiles 127 are placed in the grid openings of the T-bar grid, except at locations designated for luminaire placement. In those locations, low profile OLED luminaires in accordance with the invention, graphically represented by the thin, rectangular boxes 133, are placed in the grid openings. It can be seen that the low profile luminaires within the T-bar grid of the resulting grid ceiling 129 fit within the T-bars 31 without projecting into the space 131 above the grid ceiling. The thinner profile of the luminaires will consequently result in more space available between the dropped ceiling and the structural overhead ceiling, or, alternatively, will allow buildings to be built with lower structural ceilings.

FIG. 14B shows a dropped ceiling similar to the dropped ceiling shown in FIG. 14A, with a different arrangement of low profile OLED luminaires. In this case, the grid ceiling system 135, which is suspended below the structural ceiling 125, includes three different versions of the low profile luminaire of the invention interspersed among the ceiling tiles 127. One of the low profile luminaires 133 is a fully recessed luminaire, such as illustrated in FIG. 6. As denoted by numeral 137, another one of the luminaires provided in the ceiling system is a "surface" luminaire, such as the luminaire illustrated in FIG. 7. As denoted by the numeral 139, still another of the low profile luminaires is a partially recessed and partially surfaced luminaire, such as the luminaire illustrated in FIG. 8. It is contemplated that a grid ceiling system could use a single version of the low profile luminaire of the invention throughout the ceiling system, or could mix and match different versions of the luminaire to achieve different visual and lighting effects.

Figure 15:
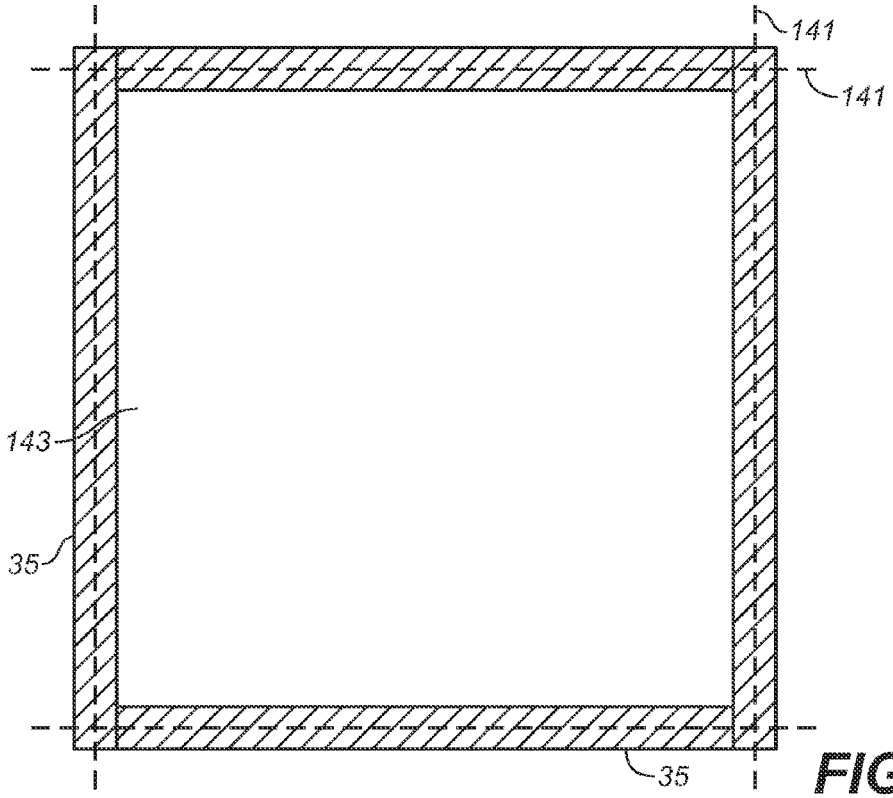
FIG. 15 is a bottom plan view of the T-bar mounted 2'×2' OLED luminaire in a recessed configuration such as, for example, shown in FIG. 9B, showing how the luminaire would look in a T-bar grid of a grid ceiling system.
Figure 17:
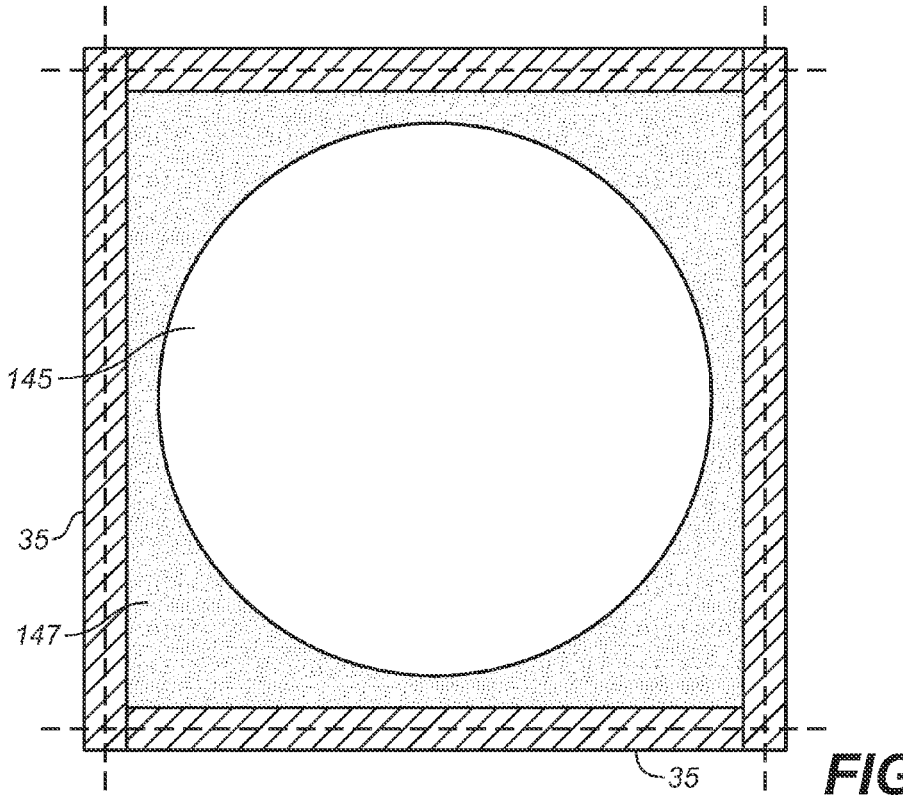
FIG. 17 is a bottom plan view of the T-bar mounted 2'×2' OLED luminaire in a recessed configuration such as, for example, shown in FIG. 9B, showing how the luminaire would look in a T-bar grid of a grid ceiling system with the OLED panel emitting light in an observable circular pattern on the bottom of the luminaire.
Figure 16:
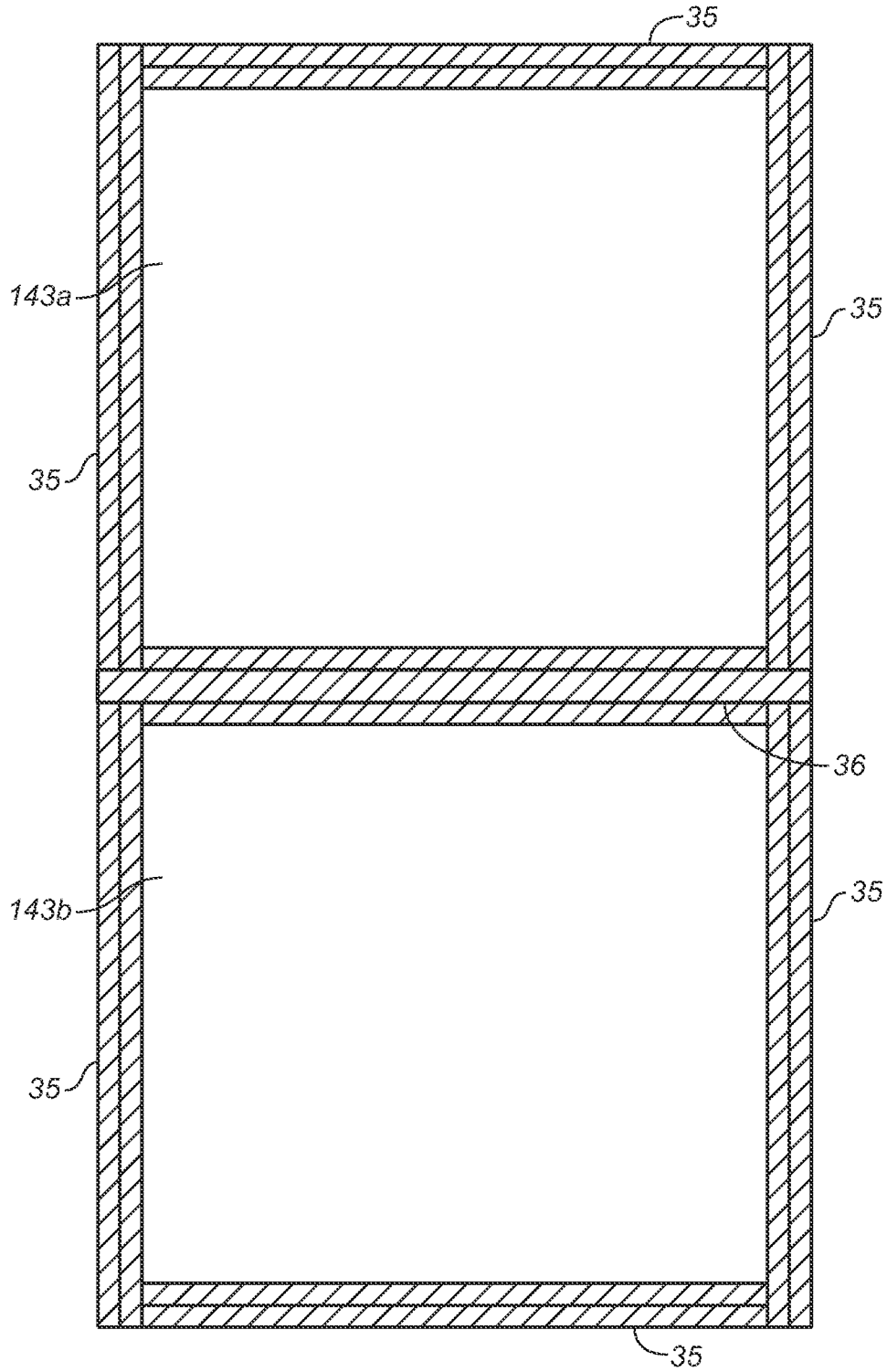
FIG. 16 is a bottom plan view of two side-by-side T-bar mounted 2'×2' OLED luminaires in a recessed configuration such as, for example, shown in FIG. 9B, showing how the luminaires would look in a 2'×4' T-bar grid of a grid ceiling system.

FIGS. 15-17 illustrate how a low profile luminaire in accordance with the invention would appear in a grid ceiling when viewed from below the ceiling, and further illustrate different patterns of luminance that can be produced from the OLED light source of the luminaire. Referring to FIG. 15, a square grid pattern, represented by dashed grid lines 141, would, for most conventional grid ceiling systems, be two feet square. A visible grid square is formed by the bottom of the horizontal T-walls 35 of the grid T-bars. In the versions of the low profile luminaires of the invention where the OLED panel (or panels) span the entire grid opening, such as in the version shown in FIG. 6, the entire space 143 between the bottom horizontal T-walls 35 forming the grid square will be filled by the OLED source. In FIG. 15, there are no contrasting luminance patterns within this area are indicated, meaning that the entire area is be uniformly illuminated. However, it is contemplated an OLED panel or multiple OLED panels can be provided that exhibit contrasting luminance patterns on the bottom light emitting surface of the panel or panels.

FIG. 16 illustrates two adjacent squares of a grid ceiling system, wherein the adjacent grid spaces 143*a*, 143*b* formed by the T-bar's bottom T-walls 35 and grid divider 36 are occupied by a nominally 2'×4' OLED panel of a 2'×4' low profile luminaire to create two nominally 2'×2' patterns of light on the grid ceiling.

FIG. 17 illustrates an example of how the planar OLED light source of the luminaire of the invention can provide a desired luminance pattern on the surface of the OLED. In this case, a circular luminance pattern 145 is produced from the light-emitting surface of the OLED panel. This can be achieved by designing the OLED such that the areas 147 of the OLED surrounding the circular area of luminance do not emit light. By constraining the surface area of the OLED from which the light is emitted, different surface patterns of light can be produced within the square grid opening of the T-bar grid defined by the T-bars' horizontal bottom T-walls 35.

Figure 18:
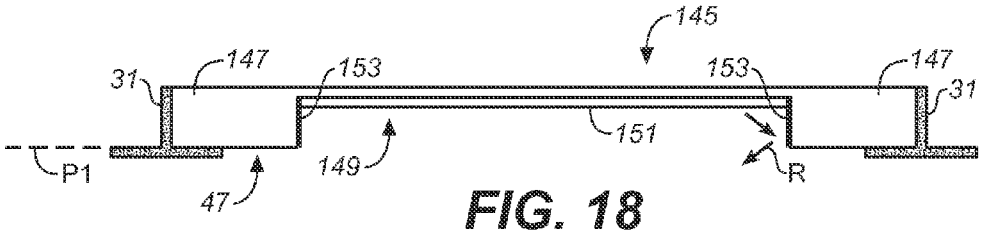
FIG. 18 is a graphical illustration of yet a further embodiment of a low profile OLED luminaire in accordance with the invention having added reflective optical elements.

FIGS. 18-22 show further variations of the low profile OLED luminaire of the invention wherein the planar OLED light source of the luminaire is recessed into the luminaire and wherein passive optical elements are incorporated into the OLED support structure proximate the OLED light source for producing visual lighting effects around the OLED from light emitted by the OLED, thereby enhancing the lighting characteristics of the luminaire. Referring to FIG. 18, the luminaire 145 includes a low profile OLED support housing 147, having a central bottom recess 149 containing the luminaire's planar OLED light source 151. The sidewalls 153 of recess 149 are provided with reflective surfaces for reflecting light emitted from the OLED light source striking the sidewall, as represented by light ray arrows R. It is seen that the OLED light source in this version of the low profile luminaire is smaller than the ceiling grid opening 47 defined by the ceiling's T-bars 31.

Figure 19:
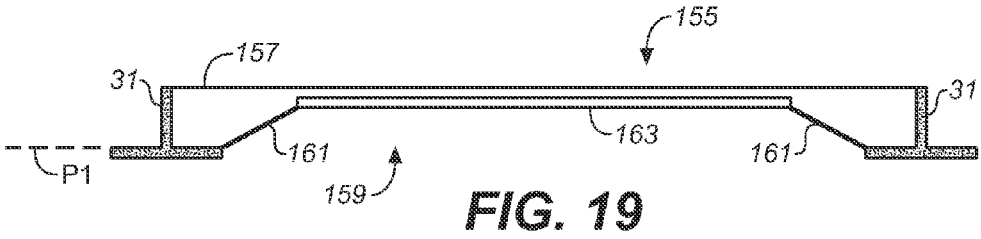
FIG. 19 is a graphical illustration of still a further embodiment of a low profile OLED luminaire in accordance with the invention having reflective optical elements in an alternative configuration.
Figure 20:
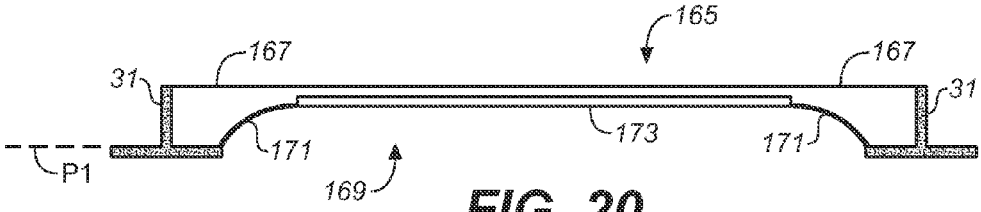
FIG. 20 is a graphical illustration of another embodiment of a T-bar mounted low profile OLED luminaire in accordance with the invention having another alternative for added reflective optical elements.

In FIG. 19, the luminaire 155 is provided with a low profile housing 157, wherein the bottom recess 159 has sloped side walls 161, which are provided with a reflective surface for reflecting light from the central OLED panel 163. FIG. 20 shows a variation of the luminaire in FIG. 19, wherein the OLED support housing 167 of luminaire 165 has a bottom central recess 169 with curved reflective sidewalls 171 for reflecting light from the luminaire's OLED panel 173. In each of the luminaires shown in FIGS. 19 and 20, the reflective surfaces surrounding the OLED light source will produce a characteristic edge-lit pattern surrounding the OLED. Such edge-lit patterns can be used to produce visual interest, and to alter light distribution and brightness contrast between adjacent surfaces of the luminaire.

Figure 21:
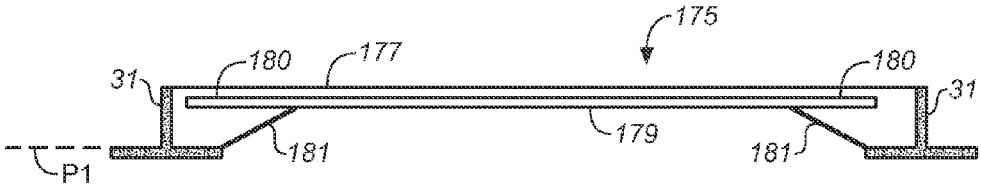
FIG. 21 is a graphical illustration of a still another embodiment of a low profile OLED luminaire in accordance with the invention to which light transmissive elements have been added.
Figure 22:
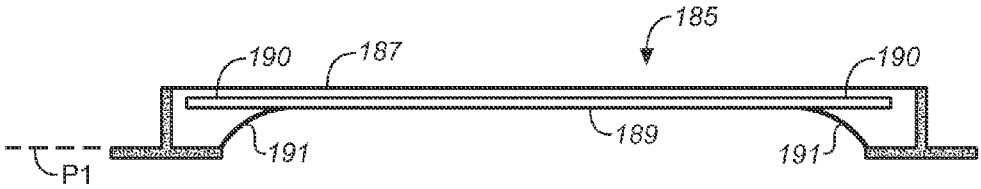
FIG. 22 is a graphical illustration of a yet another embodiment of a low profile OLED luminaire in accordance with the invention in which another version of the light transmissive elements has been added.

FIGS. 21 and 22 show further embodiments of the low profile luminaire of the invention, wherein edge-lit patterns are produced by light transmissive elements as opposed to light reflective elements. In FIG. 21, the illustrated luminaire 175 has a low profile support structure 177 for supporting a planar OLED light source 179. The support structure includes sloped light transmissive walls 181 that extend upwardly from the bottom of the support structure to the OLED panel. The OLED panel 179 extends into the support structure behind the light transmissive walls 181 such that light emitted from the ends 180 of the OLED panel will be transmitted through the light transmissive walls 181 to produce a glowing edge around the central portion of the OLED panel.

Similarly, in FIG. 22, the low profile luminaire 185 has a low profile structure 187 and an OLED light source 189 that extends behind curved light-transmissive walls 191 of the support structure. Light emitted from the extended ends 190 of the OLED will be transmitted through the curved light-transmissive walls 191 to produce another edge-lit effect around the visible center portion of the OLED. The light-transmissive walls can suitably be fabricated of a translucent material which is diffuse or semi-diffuse.

Figure 23:
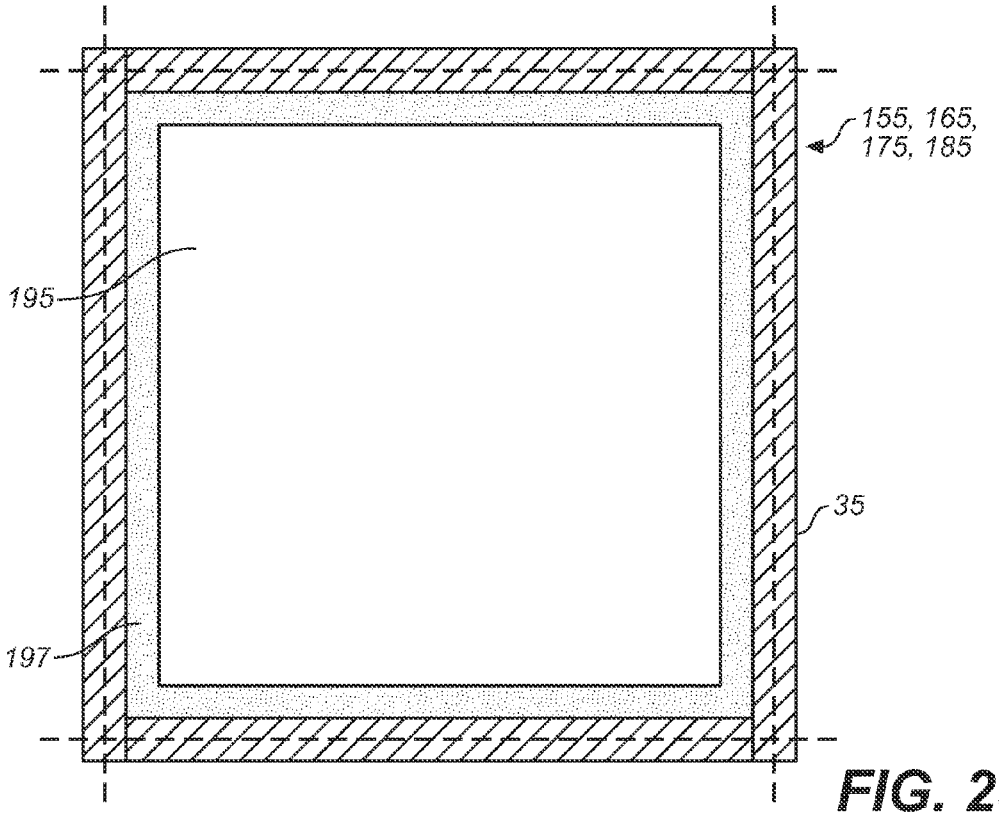
FIGS. 23 and 24 are bottom plan views of a T-bar mounted 2'×2' OLED luminaire such as shown in FIGS. 19-22, showing how the luminaire with the added optical elements might look in a T-bar grid of a grid ceiling system.
Figure 24:
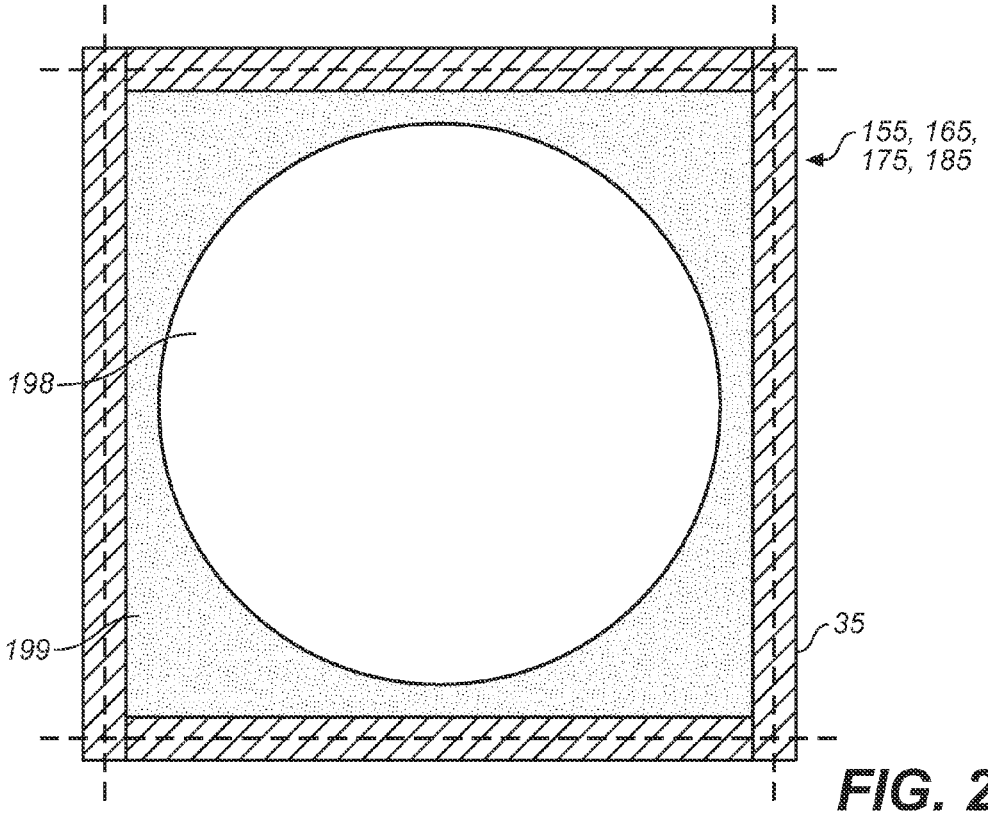

FIGS. 23 and 24 show examples of how low profile luminaires in accordance with the invention might appear when provided with edge reflectors or light-transmissive elements such as illustrated in FIG. 19-22. In FIG. 23, the directly observable portions of planar OLED light sources 163, 173, 179, 189 of the luminaires 155, 165, 175, 185 appear as a lit square 195 surrounded by a glowing rectilinear ring 197. In FIG. 24 the directly observable portions of planar OLED light sources 163, 173, 179, 189 of the luminaires 155, 165, 175, 185 appear as a lit circle 198 surrounded by a glowing edge-lit region 199 between the perimeter of the circle and the rectilinear edges of the grid opening. In the case of FIG. 24, the extended glowing edge-lit region 199 can be created by extending the reflector walls or light transmissive walls 161, 171, 181, 191 in at the corners to form a circular opening through which the light emitting surface of the OLED can be directly viewed.

Figure 25:
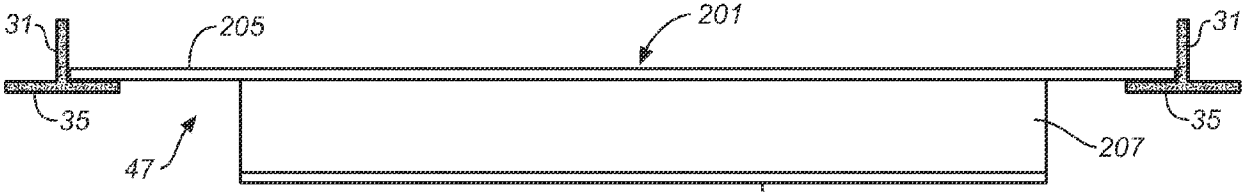
FIG. 25 is a graphical illustration of a low profile OLED luminaire in accordance with the invention having an alternative configuration for the luminaire's OLED support structure.

FIGS. 25, 26, 27 and 28A-28C show yet further versions of a low profile OLED luminaire in accordance with the invention. In these versions, the planar OLED light source of the luminaire is smaller than the T-bar grid opening, and protrudes below this opening. In FIG. 25, the low profile OLED luminaire 201 has a planar OLED light source 203, the perimeter dimension of which is smaller than grid opening 47. The OLED light source 203 is supported below a larger by a low profile OLED support structure which includes a laterally extending mounting plate 205 and a low profile box-shaped OLED support housing 207, the perimeter dimension of which matches that of the planar OLED light source. The support plate 205 is dimensioned to fit over the horizontal T-walls 35 of T-bars 31 of the T-bar grid, such that the OLED light source and support housing extend below the plane of the grid ceiling.

Figure 26:
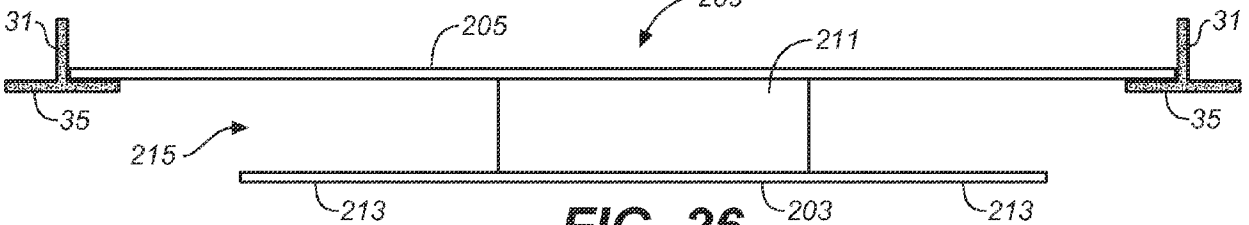
FIG. 26 is a graphical illustration of a low profile OLED luminaire in accordance with the invention having another alternative configuration for the luminaire's OLED support structure.

The low profile luminaire 209 shown in FIG. 26 is identical to the low profile luminaire 201 shown in FIG. 25, except that the luminaire is provided with a relatively small center support housing or post 211 for supporting the planar OLED panel 203 below the luminaire's mounting plate 205. In this configuration, the extended perimeter edges 213 of the OLED panel 203 extend beyond the center support housing 211 to provide a gap 215 between the extended ends of the OLED and the luminaire's mounting plate 205.

Figure 27:
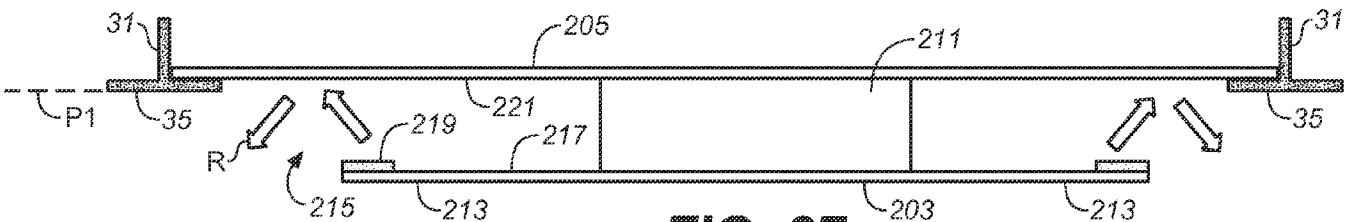
FIG. 27 is a graphical illustration thereof showing the addition of secondary light sources for providing visual enhancement thereto.

FIG. 27 illustrates how the extended perimeter edges of the OLED panel shown in FIG. 26 can advantageously be used to create different lighting effects. In FIG. 27, one or more upwardly directed secondary sources of light, represented by blocks 219, are provided on the top 217 of the extended perimeter edges 213 of the OLED panel 203, facing the mounting plate 205. These secondary light sources could, for example, be in the form of a secondary OLED or LED source mounted to the top of the OLED panel's perimeter edges, or could be provided by providing an OLED panel that emits light from the top edges of the panel as well as from the bottom surface of the panel. At least a portion of the bottom surface 221 of mounting plate 205 is provided with a reflecting surface, which could be a specular, diffuse or semi-diffuse surface. In this configuration, light emitted from the secondary source on the top perimeter edges of the OLED panel would be directed toward and reflected by the bottom reflective surface 221 of mounting plate 205, as represented by light ray arrows R. This reflection will create an illuminated surface along the bottom of the mounting plate 205, which frames the illuminated surfaces of the bottom of the OLED panel 203. All of this can be accomplished in a low profile luminaire that uniquely fits into the T-bar grid of a grid ceiling system.

Figure 28A:
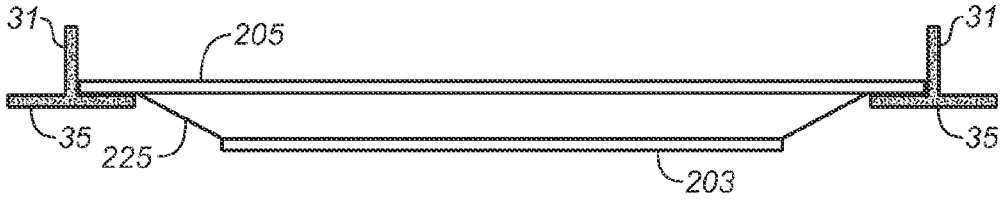
FIGS. 28A-28C are graphical illustrations of a low profile OLED luminaire in accordance with the invention having further alternative configurations for the luminaire's OLED support structure.
Figure 28B:
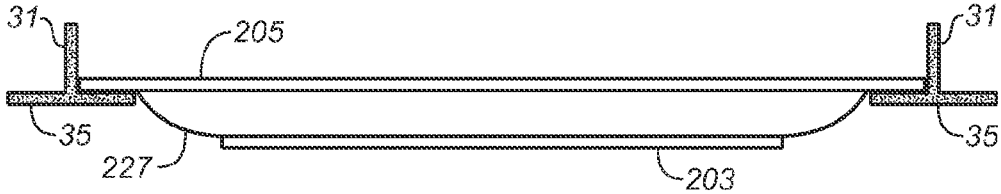
Figure 28C:
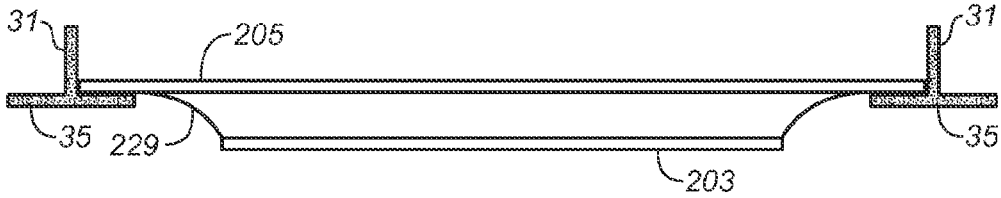

FIGS. 28A-28C illustrate variations in the protruding OLED version of the low profile luminaire, wherein the support structure for the OLED light source panel flares outwardly from the perimeter of the OLED to provide observable structure sidewalls for accenting the observable portion of the luminaire. In FIG. 28A, the OLED panel 203 has a straight, flared sidewall 225; in FIG. 28B, the support structure has convex sidewalls 227; and in FIG. 28C, the support structure has concave, flared sidewalls 229. These sidewalls could be provided with reflective surfaces to catch and reflect ambient light. They could also be translucent to transmit light internally reflected such as by means of secondary light sources such as shown in FIG. 27.

Figure 29:
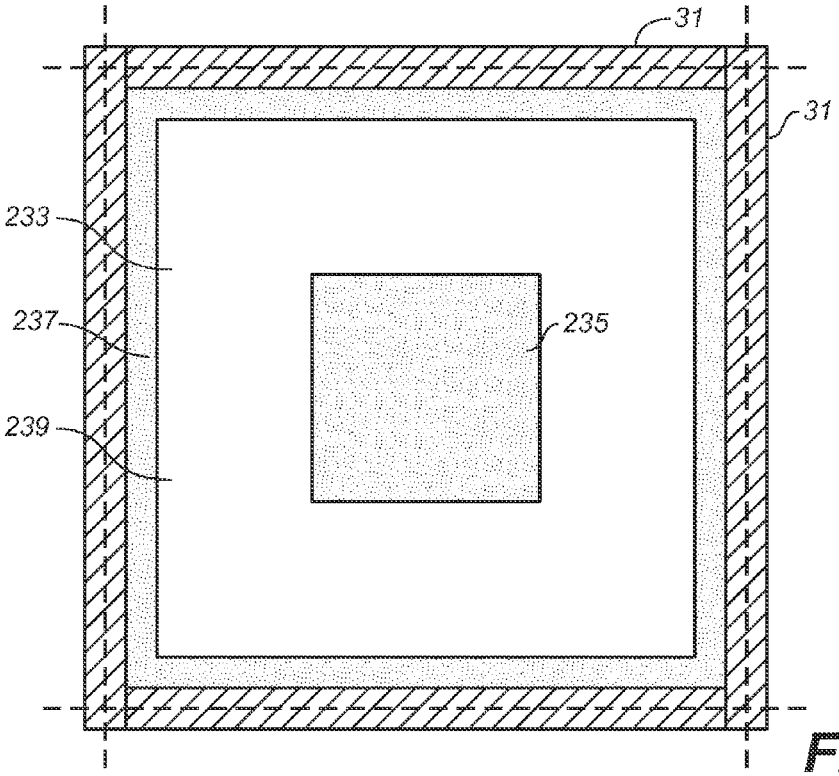
FIGS. 29 and 30 are bottom plan views of a T-bar mounted 2'×2' OLED luminaire such as shown in FIGS. 25-27 and 28A-28C, showing how the luminaire with the alternative configurations for the luminaire's OLED support structure might look in a T-bar grid of a grid ceiling system.
Figure 30:
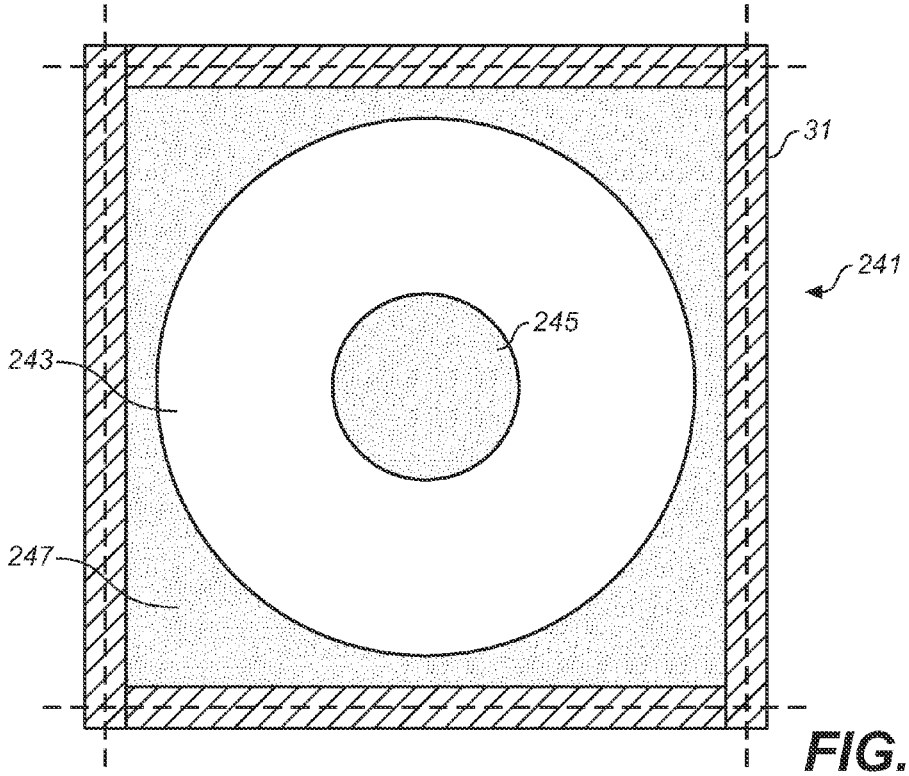

FIGS. 29 and 30 show still further alternative embodiments of the low profile OLED luminaire of the invention, wherein different lighting effects are provided on the bottom surface of the OLED lighting panel itself. In particular, FIGS. 29 and 30 show OLED panels wherein the center region of the OLED panel has a contrasting pattern relative to the outer regions of the panel. This contrasting pattern could be produced by providing an OLED panel that does not emit light at this center region, or, alternatively, an OLED panel has a center opening. Or the contrasting pattern could be produced by an OLED panel that produces a different level of luminance or luminance in of different color in the center region. In FIG. 29, the OLED panel 233 of the luminaire is seen to have a center square region 235 surrounded by an outer contrasting region 239. In addition, the bottom of the luminaire has a visible perimeter edge 237 between the outer region 239 of the OLED panel and the grid ceiling T-bars 31. This perimeter edge can be produced by features of the OLED support structure, for example, by flared edges 225, 227, and 229 of the OLED support structure shown in FIGS. 28A-28C.

FIG. 30 shows a low profile OLED luminaire 241 in a ceiling grid formed by T-bars 31, wherein the bottom of the OLED light source panel has contrasting donut-shaped region 243 and donut-hole region 245. The observable contrasting perimeter portion 247 surrounding the OLED's donut-shaped region 243 can be produced through the design of the OLED support structure. For example, if the OLED light source is a protruding OLED panel as shown in FIGS. 25-27 and 28A-28C, a disc-shaped OLED panel 203 could be mounted to a rectangular support plate 205, with observable perimeter surfaces being created by either the luminaire's mounting plate 205 (FIGS. 25-27), or the edges of the luminaire support housing (FIGS. 28A-28C).

Figure 31:
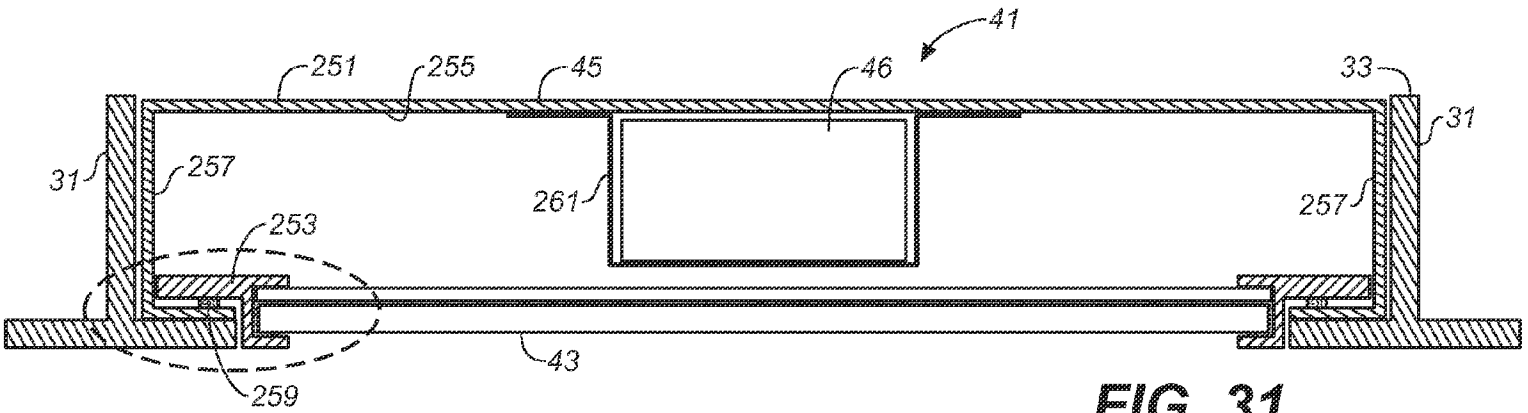
FIG. 31 is a more detailed graphical illustration of an exemplary T-bar mounted low profile OLED luminaire in accordance with the invention configured as a recessed luminaire.
Figure 32:
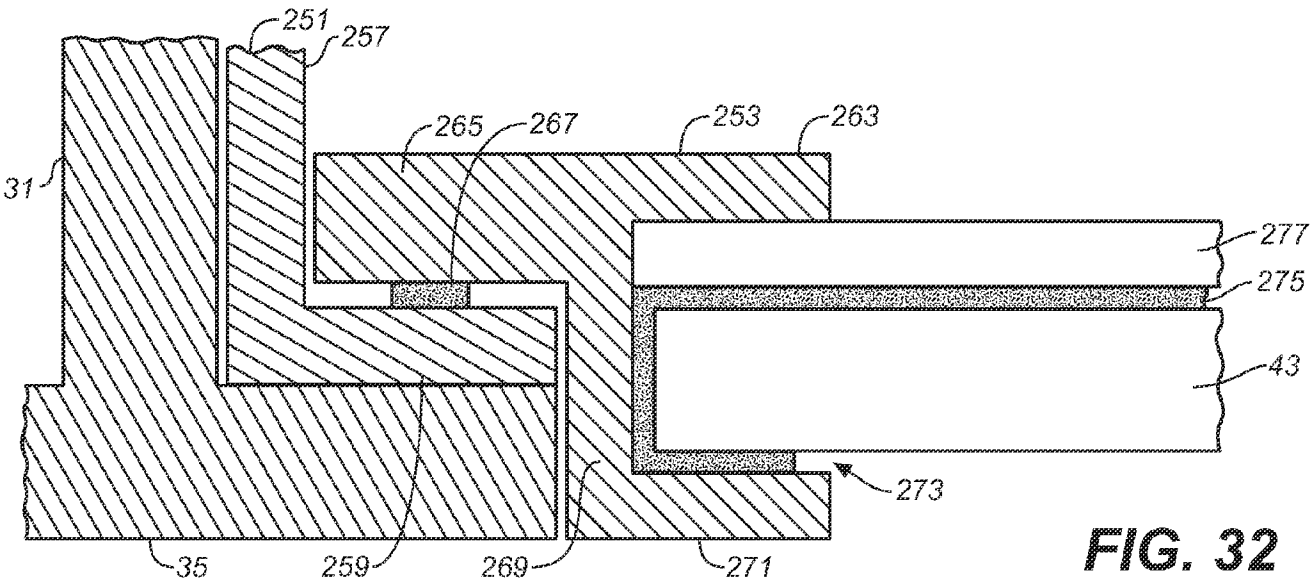
FIG. 32 is an enlarged partial view of the low profile OLED luminaire shown in FIG. 31, showing the retention structure for the OLED panel in greater detail.
Figure 33:
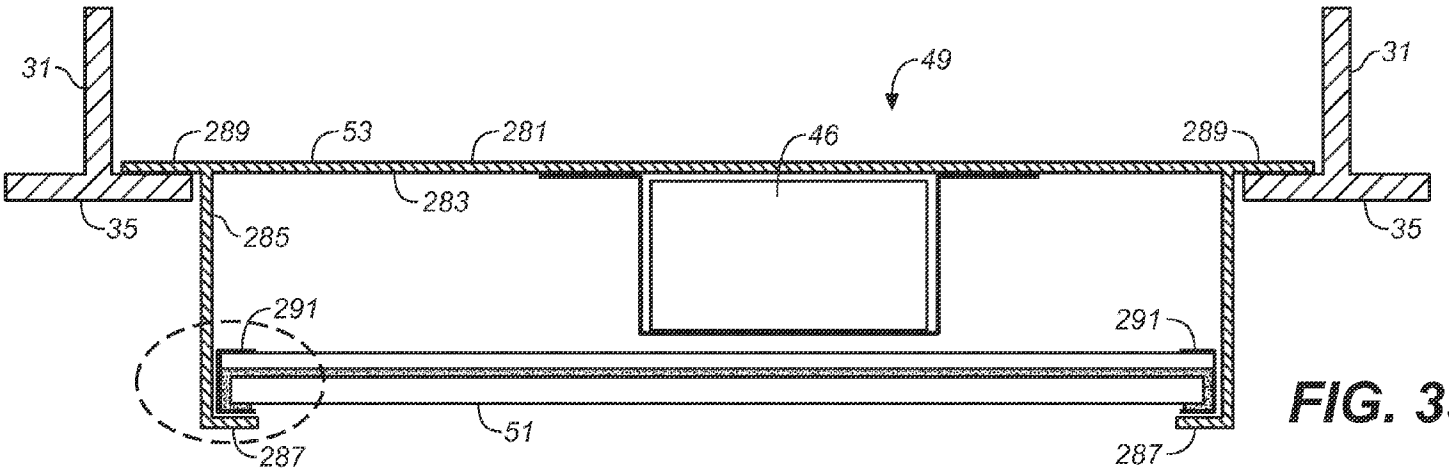
FIG. 33 is a more detailed graphical illustration of a T-bar mounted low profile OLED luminaire in accordance with the invention configured as a surface luminaire.
Figure 34:
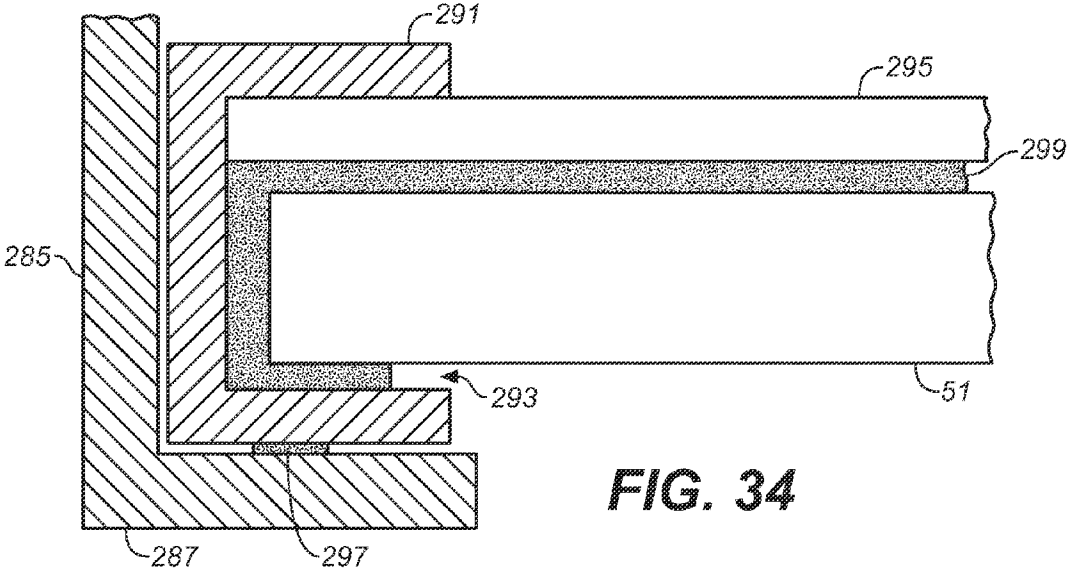
FIG. 34 is an enlarged partial view of the low profile OLED luminaire shown in FIG. 33, showing the retention structure for the OLED panel in greater detail.
Figure 35:
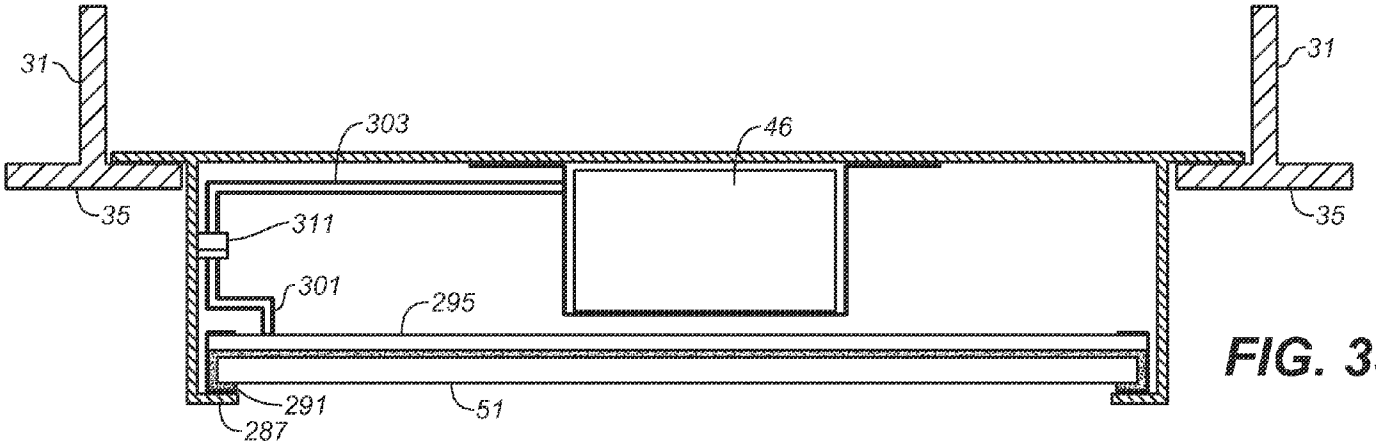
FIG. 35 is another graphical illustration thereof showing exemplary electrical connections in the low profile support structure for the OLED panel.

FIGS. 31-35 illustrate in greater detail an example of a mechanical implementation of a low profile luminaire in accordance with the invention. FIGS. 31-32 show an implementation of the low profile OLED luminaire graphically illustrated in FIG. 6, and FIGS. 33-35 show a mechanical implementation of the luminaire shown in FIG. 7. It will be understood that other mechanical implementations would be possible, and that it is not intended that the invention be limited to the implementations shown in FIG. 31-35. Also, as earlier indicated, the luminaires shown in FIGS. 31, 33 and 35 are not to scale and appear as having a height relative to their perimeter dimensions that is larger than would be the case if the luminaires were scaled to 2'×2' troffer dimensions.

Referring to FIGS. 31-32, the low profile luminaire 41 has an OLED support structure in the form of a low profile planar housing 45 comprised of a low profile top frame 251 and a lower OLED retaining frame 253 for holding the OLED panel 43 at the bottom of the top housing frame. The housing's top frame includes horizontal top wall 255, short vertical sidewalls 257, and turned-in bottom edges 259, and will preferably have a square or rectangular shape when seen in plan view (not shown), which corresponds to the T-bar grid of a grid ceiling system, and which allows the housing to fit within and be supported by the T-bars 31 of the T-bar grid. The height of the structure between horizontal top wall 255 and the OLED retaining frame 253 is preferably no greater than about two inches, and preferably no greater than or not much greater than the T-bar's vertical wall 33. In this illustrated version of the low profile luminaire, the electrical driver and control unit 46 for the OLED panel 43 is held to the top wall 255 of the housing's top frame 251 by a bracket holder 261.

FIG. 32 illustrates in greater detail an interface between the top housing frame 251 and OLED retaining frame 253 of the luminaire's OLED support structure. FIG. 32 also shows the retention of the OLED in the OLED retaining frame. The OLED retaining frame is seen to have a top channel wall 263 and a perimeter extension 265 extending from this top wall to overlap the top of the bottom turned-in perimeter edge 259 of the housing's top support frame 251. The OLED retaining frame can be secured to the top of the turned-in edge of the top support frame by any suitable means, such as a screw fastener, an adhesive, or spot-welds, denoted by the numeral 267. Alternatively, the OLED retaining frame could be "laid-in" frame that is simply set onto the perimeter edge 259 without any means of attachment. Such a "laid-in" frame would be held in the support structure by gravity and could easily be installed and removed.

The OLED retaining frame shown in FIG. 32 is further seen to have a downwardly-extending vertical channel wall 269 and an in-turned horizontal channel wall 271 which, together with the top channel wall 263, form a U-shaped OLED retaining channel 273, in which the edges of the OLED panel 43 can be secured using a suitable sealant and adhesive 275. The OLED retaining channel can be provided with sufficient width to receive the OLED panel and an OLED backing plate 277. The backing plate 277 can be provided to structurally support the OLED Panel, and the OLED panel can be suitably adhered to the backing plate by the sealant/adhesive 275.

Referring to FIGS. 33 and 34, in this "surface" version of the low profile OLED luminaire of the invention, the OLED support structure 53 has a somewhat different construction than the support structure 45 shown in FIGS. 31 and 32. Here, the OLED support structure includes a low profile planar housing comprised of a top frame 281 having a back wall 283, vertical sidewalls 285, and turned-in support edges 287 at the bottom of the vertical sidewalls. The housing perimeter dimensions, as determined by its vertical sidewalls 285, are chosen such that the housing drops through the grid opening 47 of the ceiling's T-bar grid (as defined by the bottom horizontal T-walls 35 of the shown T-bars 31). Horizontal perimeter extensions 289 are provided at the top of the housing top frame for supporting the support structure on the T-bars.

The OLED panel 51 shown in FIGS. 33 and 34 is retained above the bottom turned-in edges 287 of the housing's top frame by the OLED retaining frame 291. The OLED retaining frame has a U-shaped channel 293 for holding the perimeter edges of the OLED panel and its OLED backing plate 295. As in the embodiment illustrated in FIGS. 31-32, the OLED retaining frame can suitably be secured to the bottom turned-in edges 287 of the housing top frame 281 by a suitable attachments or welds 297, or could be laid-in without attachments. The OLED panel 51 in this version is similarly adhered to an OLED backing plate 295 by the sealant and adhesive 299, and the OLED panel and backing plate can be retained in the retaining channel 293 of the OLED retaining frame 291 by the shown sealant/adhesive.

Figure 36:
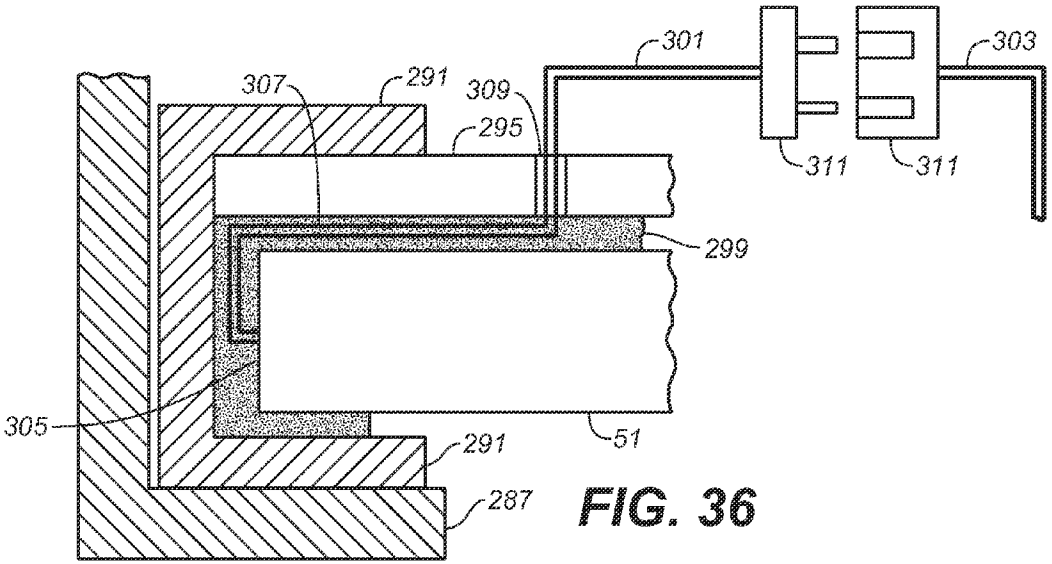
FIG. 36 is a detailed graphical illustration of the electrical connections shown in FIG. 35.

FIGS. 35 and 36 show how the OLED light source 51 can be wired to the electrical driver and control unit 46 held in the OLED support housing implementation shown in FIGS. 33 and 34. The OLED light source 51 is provided with lead wires 301, and the electrical driver and control unit for the OLED have lead wires 303. As best seen in FIG. 36, the OLED lead wires, which are attached to the edge 305 of the OLED, are threaded through the sealant-filled gap 307 between the OLED panel, the OLED retaining frame 291, and OLED backing plate 295. From there the OLED lead wires are threaded through a suitable opening 309 in the OLED backing plate, and connected to one end of an electrical connector 311. The lead wires 303 for the OLED electrical driver and control unit are connected to the other end of electrical connector 311. During assembly, the OLED would be easily connected to the electrical driver and control unit through this electrical connector.

Figure 37:
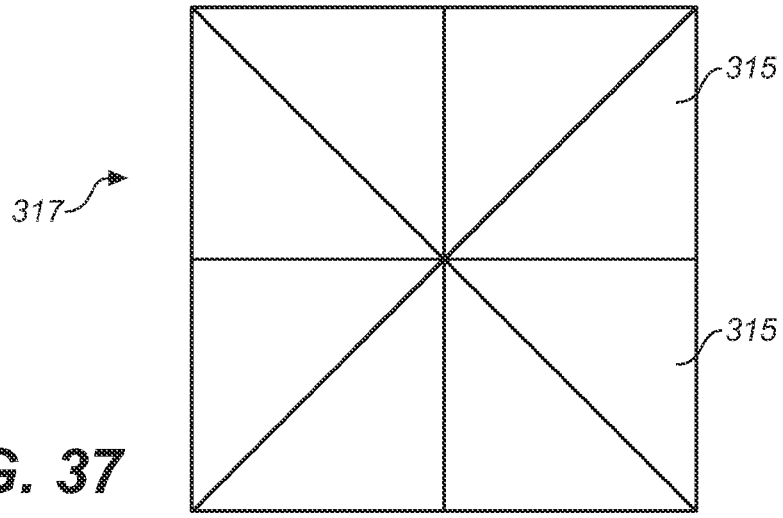
Figure 38:
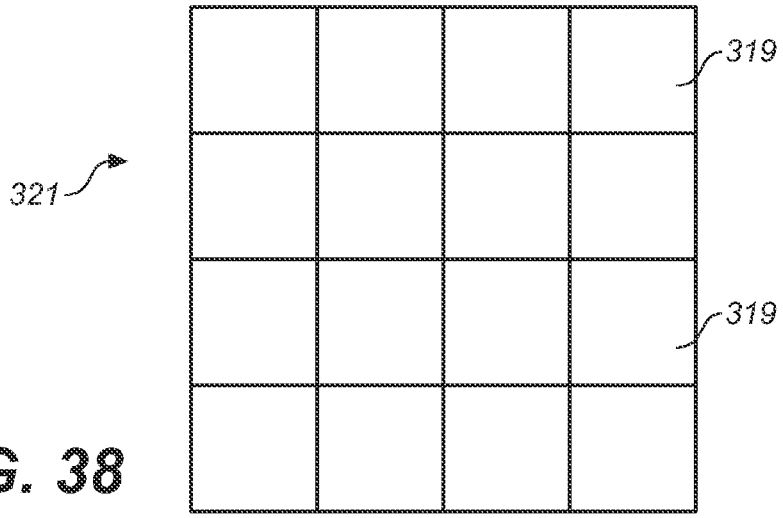
Figure 39:
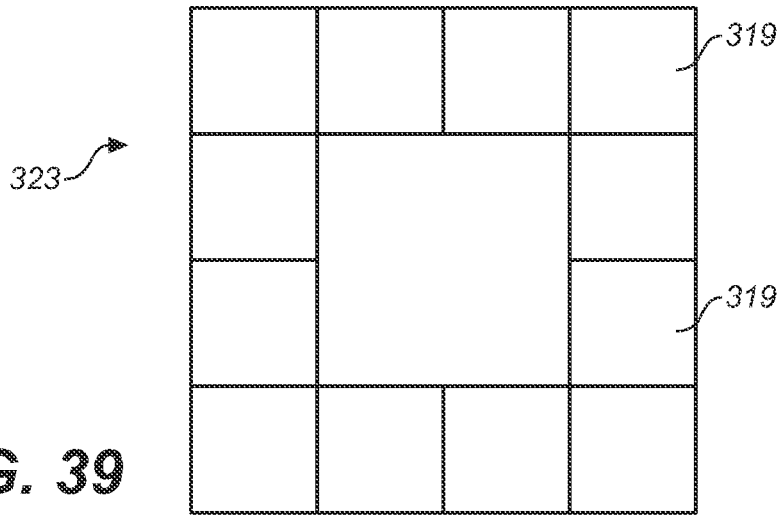
Figure 40:
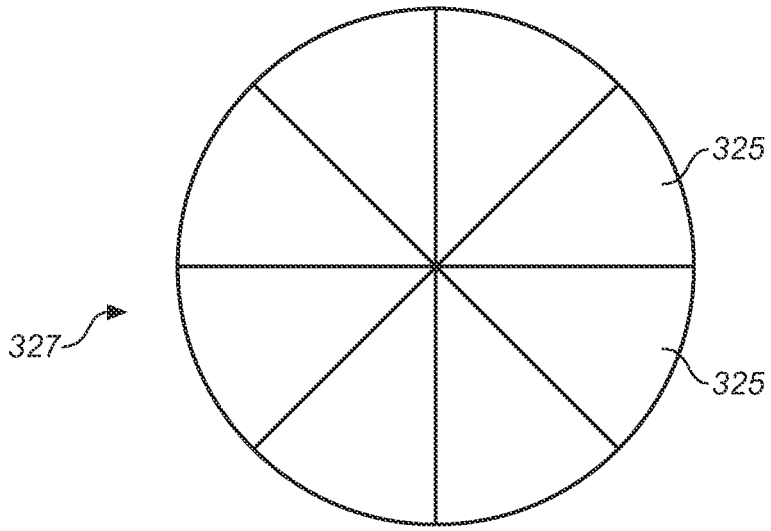
Figure 41:
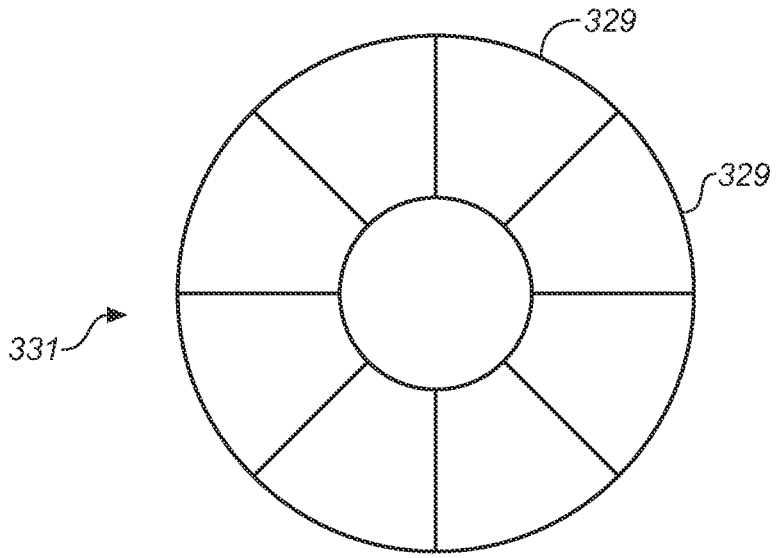

It will be appreciated that the planar OLED light source of the low profile luminaire of the invention need not be a single OLED panel, but could be made up of two or more contiguous OLED panels of different shapes to create a composite planar OLED light source of different shapes and configurations. Examples of different configurations and shapes for the planar OLED light source of the invention made up of smaller OLED panels are shown in FIGS. 37-41. In FIG. 37, pie-shaped OLED panels 315 are fitted together to form a larger square composite panel 317. These separate panels would be electrically interconnected and can be adhered to an OLED backing plate such as shown in FIGS. 31-36. In FIGS. 38 and 39, separate squared OLED panels 319 are configured, respectively, into a larger square panel 321 and a square ring 323. In FIGS. 40 and 41, pie-shaped OLED panels 325 329 form larger circular OLED panel shapes 327, 331.

While various embodiments of the invention have been described in considerable detail in the foregoing specification, it is not intended that the invention be limited to the illustrated embodiments or the described details, unless and except as expressly indicated herein.

What is claimed is:

1. A low profile luminaire for a grid ceiling wherein said grid ceiling has a T-bar grid with T-bar openings for holding ceiling tiles and lies in a defined ceiling plane, said luminaire comprising at least one planar OLED light source having a light emitting surface, and a low profile support structure for supporting said planar OLED light source, said support structure having a height and perimeter dimensions, the maximum height of the support structure substantially defining the maximum height of the luminaire, the perimeter dimensions of said support structure being chosen to allow the luminaire to fit within and be supported by the T-bar grid of the grid ceiling permitting the luminaire to be placed in the T-bar grid of a grid ceiling instead of a ceiling tile, and said support structure being configured to fix the support structure and the planar OLED light source held thereby in a predetermined plane relative to the plane of the grid ceiling when the luminaire is placed in the T-bar grid.

2. The low profile luminaire of claim 1 wherein the maximum height of said support structure is about two inches.

3. The low profile luminaire of claim 1 wherein the height of said support structure is less than about one inch.

4. The low profile luminaire of claim 1 wherein said planar OLED light source is an OLED panel that produces at least approximately 1000 lumens of light.

5. The low profile luminaire of claim 1 wherein said support structure is comprised of a low profile, substantially planar housing defining the perimeter dimensions of the low profile luminaire, said planar housing having a bottom portion and said OLED light source being supported in the bottom portion of said housing.

6. The low profile luminaire of claim 5 wherein the bottom portion of said planar housing supports the planar OLED light source in parallel relation with the plane of the grid ceiling when fitted in the T-bar grid of the grid ceiling.

7. The low profile luminaire of claim 5 wherein the bottom portion of said planar housing has a downward projecting portion sized to fit through a T-bar opening of the T-bar grid of a grid ceiling and for supporting the planar OLED light source in a plane below the plane of the grid ceiling.

8. The low profile luminaire of claim 1 wherein said OLED support structure is comprised of a low profile, substantially planar housing sized to drop through a T-bar opening in the T-bar grid of said grid ceiling and a T-bar engagement structure extending laterally of said planar housing and defining the perimeter dimensions of the support structure, and wherein said planar housing has a bottom portion and said planar OLED light source is held in the bottom portion of said housing, such that, when the low profile luminaire is placed in the T-bar grid of a grid ceiling, it is supported therein by the laterally extending T-bar engagement structure of said OLED support structure so that the planar OLED light source lies in a plane below the plane of the grid ceiling.

9. The low profile luminaire of claim 1 wherein said OLED light source has a perimeter and said OLED support structure is comprised of a low profile perimeter support structure for supporting the OLED panel around at least a portion of its perimeter.

10. The low profile luminaire of claim 9 wherein said perimeter support structure is a perimeter support frame sized to fit entirely within a T-bar of a grid ceiling.

11. A low profile luminaire for a grid ceiling wherein said grid ceiling has a T-bar grid with T-bar openings and lies in a defined ceiling plane, said luminaire comprising at least one planar OLED light source having a light emitting surface, and a low profile support structure for supporting said planar OLED light source, said support structure having a height and perimeter dimensions, the maximum height of the support structure substantially defining the maximum height of the luminaire, the perimeter dimensions of said support structure being chosen to allow the luminaire to fit within and be supported by the T-bar grid of the grid ceiling, and the low profile support structure for the planar OLED light source including a passive optical element proximate said planar OLED light source for producing a visual lighting effect proximate said OLED light source from light emitted by said OLED light source.

12. The low profile luminaire of claim 11 wherein said passive optical element surrounds said OLED panel for producing a visual lighting effect around the OLED light source.

13. The low profile luminaire of claim 11 wherein the planar OLED light source is recessed into said low profile support structure and wherein said passive optical element is an observable reflective surface within said OLED support structure that extends upward into the OLED support structure toward the light emitting surface of said OLED light source so as to receive and reflect light emitted by the light emitting surface of the OLED light source.

14. The low profile luminaire of claim 11 wherein the planar OLED light source is recessed into its low profile support structure, wherein said passive optical element is an observable light transmissive element within said OLED support structure that extends upward toward the light emitting surface of said OLED light source, and wherein a portion of the planar OLED light source extends behind the light transmissive element such that a portion of the light emitted by said OLED light source is transmitted through said light transmissive element.

15. The low profile luminaire of claim 14 wherein said light transmissive element is a translucent element.

16. A low profile luminaire for a grid ceiling wherein said grid ceiling has a T-bar grid with T-bar openings and lies in a defined ceiling plane, said luminaire comprising at least one planar OLED light source having a light emitting surface, and a low profile support structure for supporting said planar OLED light source, said support structure having a height and perimeter dimensions, the maximum height of the support structure substantially defining the maximum height of the luminaire, the perimeter dimensions of said support structure being chosen to allow the luminaire to fit within and be supported by the T-bar grid of the grid ceiling, and the low profile support structure for the planar OLED light source including a passive optical element proximate said planar light source for producing a visual lighting effect proximate said OLED light source from ambient light in the vicinity of the luminaire.

17. The low profile luminaire of claim 16 wherein said passive optical element is an observable reflective surface extending away from the light emitting surface of said OLED light source so as to receive and reflect ambient light without receiving light emitted by said light emitting surface.

18. The low profile luminaire of claim 1 comprising a plurality of planar OLED light sources each having a light emitting surface, and wherein said low profile OLED support structure supports said plurality of planar OLED light sources in a plane positioned relative to the plane of the grid ceiling.

19. The low profile luminaire of claim 1 comprising an electrical driver for the planar OLED light source contained within said OLED support structure.

20. The low profile luminaire of claim 1 wherein said OLED light source is driven by a remote electrical driver.

21. A low profile luminaire for a grid ceiling wherein said grid ceiling has a T-bar grid with T-bar openings and lies in a defined ceiling plane, said luminaire comprising at least one planar OLED light source having a light emitting surface, and a low profile support structure for supporting said planar OLED light source, said support structure having a height and perimeter dimensions, the maximum height of the support structure substantially defining the maximum height of the luminaire, the perimeter dimensions of said support structure being chosen to allow the luminaire to fit within and be supported by the T-bar grid of the grid ceiling, said support structure including a laterally extending mounting plate and a center support structure having perimeter dimensions smaller than said planar OLED light source, wherein said OLED light source has perimeter edges that extend laterally beyond said center support structure to produce a gap between the perimeter edges of the OLED light source and said mounting plate and wherein said mounting plate has observable surfaces.

22. The low profile luminaire of claim 21 wherein the perimeter edges of said OLED light source have a top that faces said mounting plate, and wherein at least one secondary light source is provided on the top of a perimeter edge of said OLED light source for directing light toward said mounting plate, the observable surfaces of said mounting plate having a reflecting surface for reflecting light from said secondary light source for producing an observable visual effect.

23. A low profile luminaire for a grid ceiling wherein said grid ceiling has a T-bar grid with T-bar openings for holding ceiling tiles and lies in a defined ceiling plane, said luminaire comprising at least one planar OLED light source having a light emitting surface and producing at least approximately 1000 lumens of light, and a low profile support structure for supporting said planar OLED light source, said support structure having a height and perimeter dimensions, the maximum height of the support structure substantially defining the maximum height of the luminaire and being no greater than about two inches, the perimeter dimensions of said support structure being chosen to allow the luminaire to fit within and be supported by the T-bar grid of the grid ceiling permitting the luminaire to be placed in the T-bar grid of a grid ceiling instead of a ceiling tile, and said support structure supporting said planar OLED light source in parallel relation with the plane of the grid ceiling when the luminaire is fitted in the T-bar grid of the grid ceiling and being configured to fix the support structure and the planar OLED light source held thereby in a predetermined plane relative to the plane of the grid ceiling when the luminaire is placed in the T-bar grid.

24. The low profile luminaire of claim 23 wherein the height of said support structure is less than about one inch.

25. The low profile luminaire of claim 23 wherein the height of said support structure is comparable to the thickness of a ceiling tile.

26. The low profile luminaire of claim 23 comprising a plurality of planar OLED light sources each having a light emitting surface and collectively producing at least approximately 1000 lumens of light, and wherein said low profile OLED support structure supports said plurality of planar OLED light sources in a plane.

27. The low profile luminaire of claim 26 wherein said plurality of planar OLED light sources are arranged in a pattern such that light emitted from the light emitting surface of said OLED light sources produce produces a desired observable pattern of light on said low profile luminaire for a desired visual effect.

28. The low profile luminaire of claim 23 wherein said planar OLED light source is provided with a perimeter shape to produce a desired observable pattern of light on said low profile luminaire for a desired visual effect.

29. The low profile luminaire of claim 23 wherein said low profile support structure has rectilinear perimeter dimensions of about two feet by two feet for fitting into a two foot by two foot T-bar grid of a grid ceiling.

30. The low profile luminaire of claim 23 wherein said low profile support structure has rectilinear perimeter dimensions of about two feet by four feet for fitting into a two foot by four foot T-bar grid of a grid ceiling.

31. A low profile luminaire for a grid ceiling wherein said grid ceiling has a T-bar grid with T-bar openings for holding ceiling tiles and lies in a defined ceiling plane, said luminaire comprising at least one planar OLED light source having a light emitting surface, and a low profile support structure for supporting said planar OLED light source, said support structure supporting said OLED light source in a plane such that the resulting luminaire has a generally thin planar envelope, the maximum height of which is substantially defined by the maximum height of the low profile support structure, and wherein the maximum height of said support structure is no greater than about two inches, said low profile support structure having the perimeter dimensions chosen to allow the luminaire to fit within and be supported by the T-bar grid of the grid ceiling permitting the luminaire to be placed in the T-bar grid of a grid ceiling instead of a ceiling tile, and being configured to fix the support structure and the planar OLED light source held thereby in a predetermined plane relative to the plane of the grid ceiling when the luminaire is placed in the T-bar grid.

32. The low profile luminaire of claim 31 wherein the height of said support structure is less than about one inch.

33. The low profile luminaire of claim 31 wherein the height of said support structure is comparable to the thickness of a ceiling tile.

* * * * *